US012071203B2

(12) United States Patent
Mines

(10) Patent No.: US 12,071,203 B2
(45) Date of Patent: Aug. 27, 2024

(54) UNDERWATER POWER UNIT

(71) Applicant: ALFASURF LTD., Yavne (IL)

(72) Inventor: Hay-Amihay Mines, Yavne (IL)

(73) Assignee: ALFASURF LTD., Yavne (IL)

( * ) Notice: Subject to any disclaimer, the term of this patent is extended or adjusted under 35 U.S.C. 154(b) by 438 days.

(21) Appl. No.: 17/616,671

(22) PCT Filed: Jul. 18, 2021

(86) PCT No.: PCT/IL2021/050873
§ 371 (c)(1),
(2) Date: Dec. 5, 2021

(87) PCT Pub. No.: WO2022/018719
PCT Pub. Date: Jan. 27, 2022

(65) Prior Publication Data

US 2022/0315173 A1 Oct. 6, 2022

(30) Foreign Application Priority Data

Jul. 23, 2020 (IL) ..... 276261

(51) Int. Cl.
*B63B 32/10* (2020.01)
*B63B 32/40* (2020.01)
*B63B 32/60* (2020.01)

(52) U.S. Cl.
CPC ..... *B63B 32/10* (2020.02); *B63B 32/40* (2020.02); *B63B 32/60* (2020.02)

(58) Field of Classification Search
CPC ..... B63B 32/10; B63B 32/40; B63B 32/60; B63B 32/70; B63H 20/02
See application file for complete search history.

(56) References Cited

U.S. PATENT DOCUMENTS 5,105,753 A 4/1992 Chih et al.
6,647,912 B1 * 11/2003 Rogers ..... B63C 11/46 440/6
8,702,458 B2 4/2014 Preston
9,045,202 B1 6/2015 Alarcon et al.
10,200,522 B2 2/2019 Berggren
(Continued)

FOREIGN PATENT DOCUMENTS

WO 2005058685 A1 6/2005

OTHER PUBLICATIONS

Sakellariou et at., (2017) Optimisation of the surfboard fin shape using computational fluid dynamics and genetic algorithms. Proceedings of the Institution of Mechanical Engineers, Part P: Journal of Sports Engineering and Technology 231(4): 344-354. Author Accepted Manuscript. 40 pages; Retrieved Dec. 6, 2021; DOI: 10.1177/1754337117704538.
(Continued)

*Primary Examiner* — Anthony D Wiest
(74) *Attorney, Agent, or Firm* — The Roy Gross Law Firm, LLC; Roy Gross

(57) ABSTRACT

The present invention provides devices and kits for modifying a standard surfboard into a motorized surfboard, utilizing a detachable modular underwater power unit, wherein said underwater power unit is configured to be attached to various standard fins or a fin unit, and wherein the underwater power unit is further configured be utilized for diving and/or swimming applications.

17 Claims, 16 Drawing Sheets

(56) References Cited

U.S. PATENT DOCUMENTS

| | | | | |
|---|---|---|---|---|
| 10,266,239 | B2 | 4/2019 | Fry | |
| 11,459,068 | B2 * | 10/2022 | Ostanin | B63B 32/10 |
| 2003/0167991 | A1 | 9/2003 | Namanny | |
| 2018/0072383 | A1 | 3/2018 | Montague et al. | |
| 2018/0170502 | A1 | 6/2018 | Terada | |
| 2018/0208286 | A1 | 7/2018 | MacFarlane | |
| 2018/0229820 | A1 | 8/2018 | Bell | |
| 2018/0324341 | A1 | 11/2018 | Immel | |
| 2019/0233076 | A1 | 8/2019 | Aldama | |
| 2021/0147040 | A1 | 5/2021 | Ostanin et al. | |

OTHER PUBLICATIONS

Shormann et al., (2020) Performance evaluation of humpback whale-inspired shortboard surfing fins based on ocean wave fieldwork. PloS One 15(4): e0232035; 17 pages; Retrieved Dec. 6, 2021; https://doi.org/10.1371/journal.pone.0232035.

Lefeet S1 waterscooter. Retrieved from: https://www.lefeet.com on Aug. 5, 2020. 16 pages.

PCT International Search Report for International Application No. PCT/IL2021/050873, completed Nov. 24, 2021, 3pp.

PCT Written Opinion for International Application No. PCT/IL2021/050873, completed Nov. 24, 2021, 4pp.

* cited by examiner

UNDERWATER POWER UNIT

This application is a National Phase of PCT Patent Application No. PCT/IL2021/050873 having International filing date of Jul. 18, 2021, which claims the benefit of Israel Patent Application No. 276261 filed on Jul. 23, 2020, the contents of which are all incorporated herein by reference in their entirety.

FIELD OF THE INVENTION

Provided herein are devices and kits for modifying a standard surfboard into a motorized surfboard, utilizing a detachable underwater power unit, wherein said underwater power unit can further be utilized for diving and/or swimming uses.

BACKGROUND OF THE INVENTION

Modern surfboards typically consist of an elongated surface made of polymer materials covered by fiberglass or epoxy resin coatings. Over the years, one or more fins (also named rudders or skegs) were added at the tail end at the bottom of the board, in order to improve directional stability and control on the surfboard. In the early 90's removable fin control systems (FCS) were developed and became the standard in the surfing industry, thus allowing fins to be easily removed and/or replaced. These systems provided surfers with the ability to alter the riding characteristics of the surfboard, by changing the amount, location, size, shape, and type of the fins which are used.

In order to improve various aspects of the surfing experience, motorized surfboards can be utilized. The addition of a motor to a surfboard have several advantages, such as: changing the hydrodynamic effect on the board, thus improving the control and/or stability of a surfer over the surfboard during different stages of surfing; facilitating surfers to accelerate the surfboard in order to "catch a wave"; and assisting surfers to paddle out away from and/or back to, the shore.

Motorized surfboards were previously suggested. For example, U.S. Pat. No. 10,266,239 discloses a fin for a surfboard which includes an integral tubular tunnel. An electric motor and associated propeller are enclosed within the integral tunnel. The integral tunnel and propeller are both positioned so that there is a blade section above and below the integral tunnel, each having a height which is at least substantially 70% of the diameter of the integral tunnel, and the motor and the propeller are positioned forward of a rear edge of the fin.

U.S. Pat. No. 8,702,458 discloses a powered water sports board which includes a motor and a power supply, both of which are mounted inside a cavity formed inside an elongate buoyant body of the powered water sports board, and a propeller which is capable of being driven by the motor and which is housed inside a fin of the elongate buoyant body thereby to shield the propeller.

U.S. Pub. No. 2003/0167991 discloses a kit for converting a conventional surfboard into a motorized one, to assist a surfer in paddling away from shore. The kit includes a small motor attachable to the surfboard and a control remote, where the electric motor is built directly into a rudder or fin, which is attachable to the surfboard without any structural modification to the board.

However, the previous motorized surfboards hold several drawbacks, such as their lack of modularity, their incapability to attach various types of fins and/or surfboards, or their inability to be adapted for diving or swimming applications. There remains an unmet need for simple, economical, efficient and modular motorized devices and systems for improved surfing and/or diving activities.

SUMMARY OF THE INVENTION

The present invention provides underwater power units configured to be detachably attached to a surfboard's bottom at the tail section, thereby transforming a standard surfboard into a motorized surfboard. The underwater power units of the present invention are further configured to be utilized for diving or swimming applications.

According to an aspect of the present invention, there is provided an underwater power unit comprising: (a) a power source housing comprising at least one power source disposed therein; (b) a main body comprising: a main body top surface comprising an upper main body adaptor platform configured to be detachably attached to an adaptor unit; a main body bottom surface comprising a lower fin attachment section configured to have a fin unit detachably attached thereto; a motor; and a control unit, wherein the main body top surface and main body bottom surface are located at opposing external surfaces of the main body, wherein at least one of the motor and the control unit are disposed within the main body, wherein the motor is coupled to a propeller via a shaft, wherein the motor is configured to be electronically coupled to the at least one power source and to receive electric power therefrom, wherein the motor is configured to generate a rotation of the propeller about a central longitudinal axis; (c) a rear unit comprising said propeller and a protective cowling, wherein the protective cowling at least partially encompasses the propeller and a portion of said shaft; and (d) a fin unit comprising at least two walls, wherein each wall exhibits an outer surface and an inner surface opposing the outer surface, wherein the inner surfaces of the at least two walls define a hollow fin space therebetween, wherein the fin unit is configured to be detachably attached to the main body, wherein the underwater power unit extends from an underwater power unit front end towards an underwater power unit rear end along the central longitudinal axis, and wherein the shaft extends from the motor in a distal direction towards the underwater power unit rear end.

According to some embodiments, the fin unit comprises the power source housing disposed therein, wherein the power source housing comprises the at least one power source disposed therein.

According to some embodiments, the at least one power source is a battery. According to some embodiments, the at least one power source comprises a plurality of batteries. According to some embodiments, the plurality of batteries are aligned in a row.

According to some embodiments, the power source housing is disposed within the hollow fin space and is in direct contact with the inner surfaces of the fin unit. According to some embodiments, the power source housing comprising the plurality of batteries is disposed within the hollow fin space, and the plurality of batteries are in direct contact with the inner surfaces of the fin unit.

According to some embodiments, the fin unit further comprises a power source controller disposed therein, wherein said controller is configured to transfer and balance electric power from the plurality of batteries to the motor.

According to some embodiments, the fin unit comprises at least one thermally conductive material.

According to some embodiments, the fin unit further comprises a fin unit cover configured to be secured or attached to the lower fin attachment section utilizing attachment means selected from the group consisting of: bolts, screws, set screws, nails, pins, latches, snap-fit fasteners, bayonet mounts, and combinations thereof.

According to some embodiments, the central longitudinal axis extends through at least a portion of the control unit and at least a portion of the motor.

According to some embodiments, during the attachment of the main body to the fin unit, the underwater power unit front end of the main body and a front end of the outer surface of the fin unit are flush and form a continuous outer surface.

According to some embodiments, the power source housing is detachably attached to the main body through various releasable mechanisms selected from the group consisting of: a snap-fit fastener, bayonet mount, a latch, and a releasable engagement mechanism, and wherein the power source housing is aligned with the main body along the central longitudinal axis, when attached thereto.

According to some embodiments, the control unit is located in a respective position radially offset from the central longitudinal axis and the motor, wherein the main body further comprises a control unit housing located in a respective position radially offset from the central longitudinal axis and extending downward from the main body bottom surface, wherein the control unit is disposed within the control unit housing. According to some embodiments, a processor and at least one of a communication module and an ESC are located in respective positions radially offset from the central longitudinal axis and the motor, wherein the main body further comprises a control unit housing located in a respective position radially offset from the central longitudinal axis and extending downward from the main body bottom surface, wherein the processor and at least one of the communication module and the ESC are disposed within the control unit housing.

According to some embodiments, the fin unit is configured to interact with or to encompass the control unit housing, and wherein the hollow fin space enables the inner surfaces of the fin unit to encompass and contact the control unit housing when attached thereto.

According to some embodiments, the fin unit is configured to be detachably attached to the lower fin attachment section of the main body utilizing attachment means selected from the group consisting of: bolts, screws, set screws, nails, pins, latches, snap-fit fasteners, bayonet mounts, and combinations thereof.

According to some embodiments, the control unit housing comprises at least one thermally conductive material.

According to some embodiments, the fin unit further comprises at least one heat expel element configured to enable heat transportation from the control unit housing to the surrounding environment therethrough. According to some embodiments, the at least one heat expel element is a heat expel opening comprising at least one opening extending through at least one wall of the fin unit, configured to enable direct contact between the control unit housing and the surrounding environment. According to some embodiments, the at least one heat expel element is a heat expel conducting surface comprising a highly conductive thermal material. According to some embodiments, the fin unit comprises a plurality of heat expel elements. According to some embodiments, each one of the outer surfaces of the fin unit comprises: a heat expel opening, a first heat expel conducting surface and a second heat expel conducting surface.

According to some embodiments, a ratio between a base width and a height of the fin unit is selected from the range of about 0.1-0.5.

According to some embodiments, the underwater power unit further comprises the adaptor unit, wherein the adaptor unit comprises an adaptor coupling surface configured to be detachably attached to the upper main body adaptor platform, and at least one of a board coupling portion or a user interaction portion.

According to some embodiments, the adaptor unit further comprises a board coupling portion configured to be secured to a standard slot of a standard surfboard, thereby enabling detachable attachment of the underwater power unit to a standard surfboard. According to some embodiments, the board coupling portion comprises FCS tabs, FCS II tabs, futures single tab, or a combination thereof.

According to some embodiments, the adaptor unit further comprises a user interaction portion configured to be held by, or be secured to, the user, thereby connecting the underwater power unit directly to the user. According to some embodiments, the user interaction portion comprises at least one of: a double handle, a single handle, an elastic strap, and combinations thereof.

According to some embodiments, the control unit comprises a processor and at least one of an electronic speed control unit (ESC) and a communication module. According to some embodiments, the processor is in functional communication with at least one of the ESC, the communication module, the motor, the power source, or a combination thereof.

Certain embodiments of the present invention may include some, all, or none of the above advantages. Further advantages may be readily apparent to those skilled in the art from the figures, descriptions, and claims included herein. Aspects and embodiments of the invention are further described in the specification herein below and in the appended claims.

Unless otherwise defined, all technical and scientific terms used herein have the same meaning as commonly understood by one of ordinary skill in the art to which this invention pertains. In case of conflict, the patent specification, including definitions, governs. As used herein, the indefinite articles "a" and "an" mean "at least one" or "one or more" unless the context clearly dictates otherwise.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

BRIEF DESCRIPTION OF THE FIGURES

Some embodiments of the invention are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

In the Figures.

DETAILED DESCRIPTION

Figure 1:
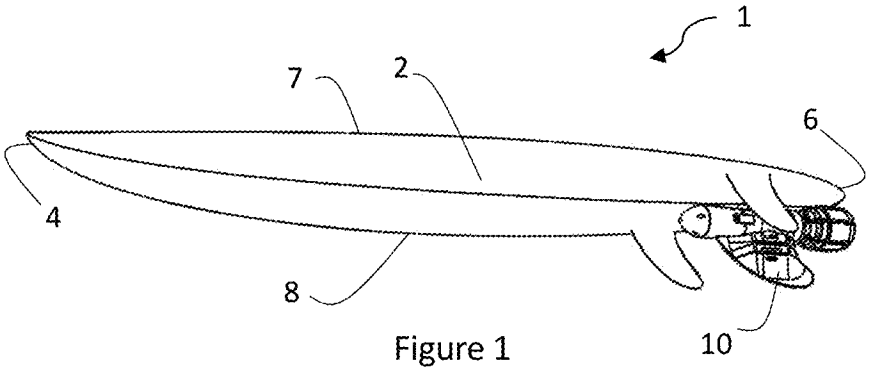
FIG. 1 constitutes a view in perspective of a motorized surfboard 1, according to some embodiments.

The present invention provides underwater power units, which in some aspects are adapted to be detachably attached to a surfboard's bottom at the tail section, thereby transforming a standard surfboard into a motorized surfboard. The underwater power units of the present invention can be further adapted, according to some aspects, for diving and/or swimming applications.

Advantageously, the underwater power units of the present invention can be used to improve the control and stability of a user (e.g., a surfer) over a surfboard, during the various stages of surfing. Additionally, an underwater power unit can be further used to assist users to paddle out away from and/or back to, the shore. Since "catching a wave" requires the user to manually paddle and to build up adequate speed so that the surfboard can properly accelerate down a wave, the underwater power units of the present invention can further assist users to accelerate the surfboard in order to properly "catch a wave" with relative ease. Said advantages of the present underwater power units can be particularly useful for beginner users, who are not accustomed to the physical requirements and the operational maneuvers of surfing. Additionally, the advantages of the present underwater power units can be useful to users suffering or recovering from various types of injuries (such as but not limited to, arm, shoulder or back injuries).

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure. In the figures, like reference numerals refer to like parts throughout.

According to some embodiments, there is provided an underwater power unit 10. Reference is now made to FIG. 1, which constitutes a view in perspective of a motorized surfboard 1, according to some embodiments. FIG. 1 illustrates the attachment of an underwater power unit 10 to a standard surfboard 2, in order to form a motorized surfboard 1, according to some embodiments.

The standard surfboard 2 is typically made from an elongated platform having an upper surfboard surface 7 configured to support the user (surfer), and a bottom surfboard surface 8 configured to face the water. The standard surfboard 2 typically further comprise a surfboard nose 4 at the front, and a surfboard tail 6 at the rear side of the surfboard. According to some embodiments, the standard surfboard 2 further comprise at least one standard slot (not shown) at the bottom surfboard surface 8 in the vicinity of the surfboard tail 6. Said at least one slot is configured to interact with or to receive a standard fin or rudder. The standard surfboard 2 can be made from a variety of materials and have different dimensions and shapes, corresponding to various users and uses. The standard surfboard 2 can be selected from a shortboard, longboard, soft-board, fish surfboard, funboard (Malibu) surfboard, gun surfboard, stand-up paddleboard (SUP), and variations thereof. Each possibility represents a separate embodiment.

The terms "standard slot" and "fix box", as used herein, are interchangeable, and refer to an elongated opening located at the bottom surfboard surface 8 in the vicinity of the surfboard tail 6, configured to interact with or to receive a standard fin or rudder, or the underwater power unit 10 of the present invention as detailed herein. The standard slot can have different configurations, shapes or lengths, corresponding to various standard fin types having various types of tabs. According to some embodiments, the standard slot is selected from FCS fin box, FCS II fin box, futures fin box, O'Fish'l fix box, soft-board fix box, SUP fix box, and other fin boxes known in the art. Each possibility represents a separate embodiment.

The terms "standard fin" and "standard rudder", as used herein, are interchangeable, and refer to a detachable fin of a modern surfboard. The standard fin can be selected from various types of fins, such as FCS fins, FCS II fins, futures fins, or any other type of fin known in the art.

The standard surfboard 2 can have various fin configurations, such as a single fin, twin fin, thruster/tri fin, quad fin, 5-fin, or 2+1 fin configuration. Each possibility represents a separate embodiment. According to some embodiments, the standard surfboard 2 comprise at least one, at least two, at least three, or at least four standard slots. According to some embodiments, the standard surfboard 2 comprises five standard slots. According to some embodiments, the standard surfboard 2 comprises a plurality of standard slots.

According to some embodiments, underwater power unit 10 is configured to be detachably attached to the at least one standard slot, without any structural modification to standard surfboard 2. The standard surfboard 2 can be connected to a single underwater power unit 10. The standard surfboard 2 can be connected to a plurality of underwater power units 10. The standard surfboard 2 can be connected to a combination of standard fins and at least one underwater power unit 10. The standard surfboard 2 can be connected to at least two standard fins and at least one underwater power unit 10, as illustrated at FIG. 1.

Figure 2A:
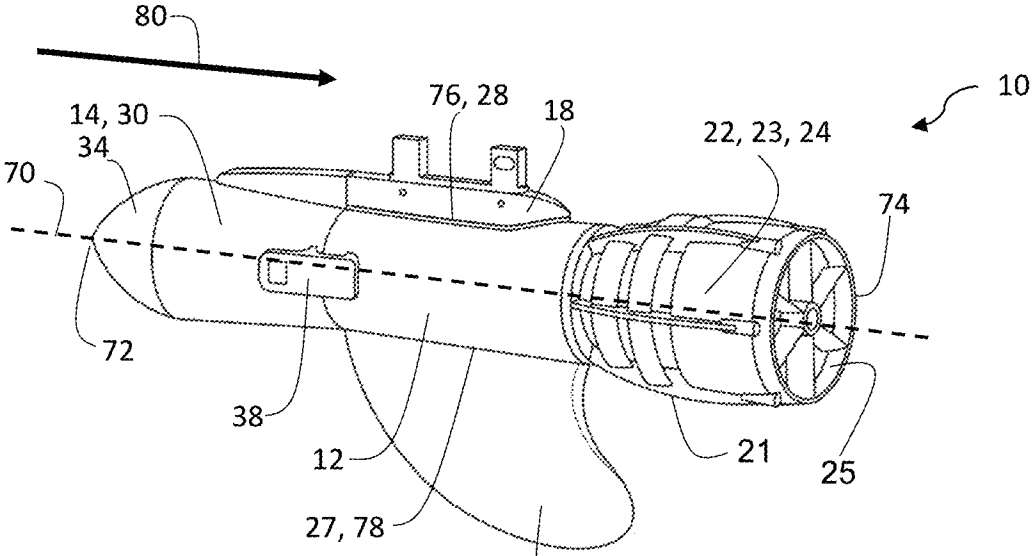
FIG. 2A constitutes a view in perspective of an underwater power unit 10, according to some embodiments.
Figure 2B:
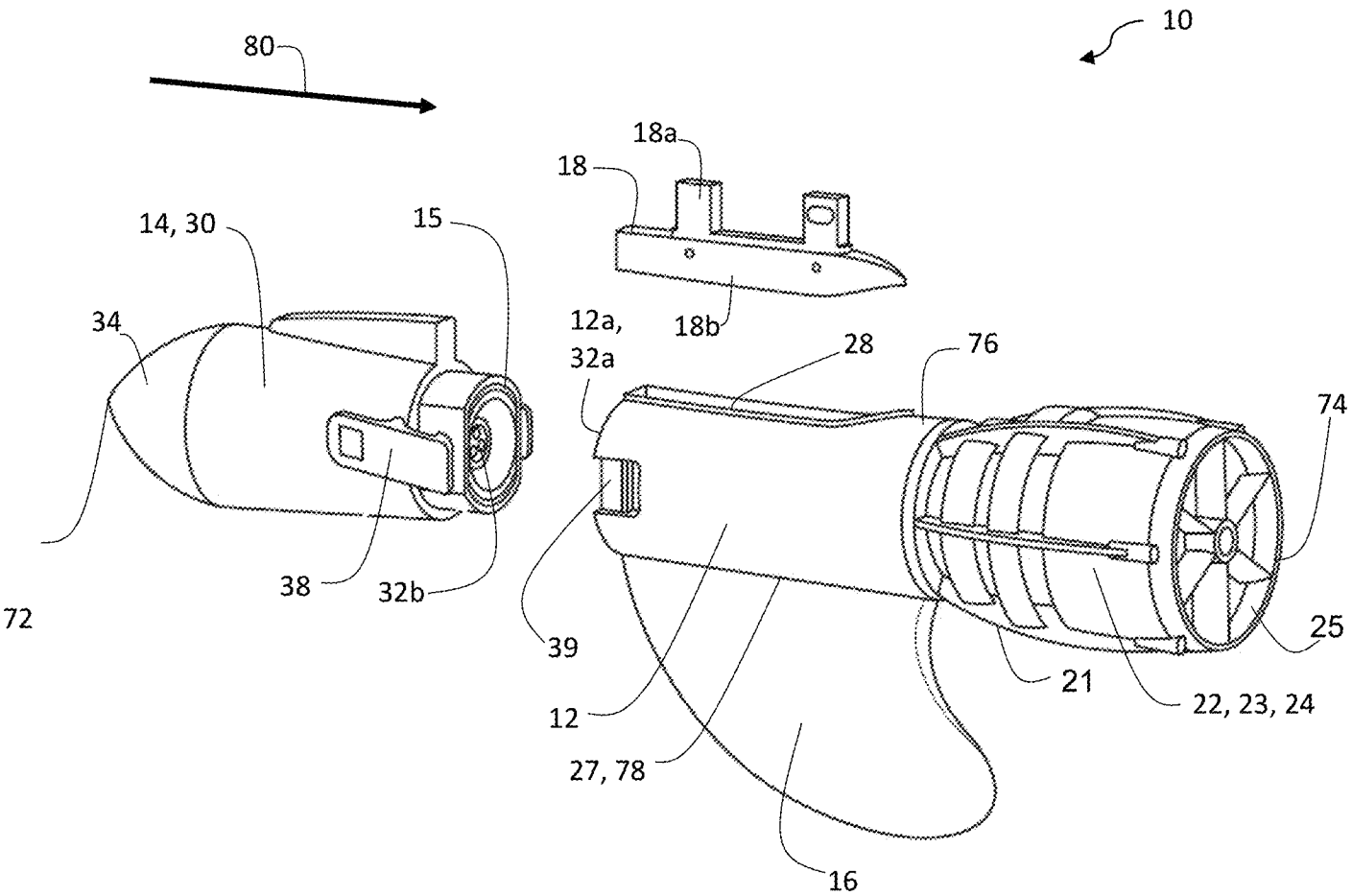
FIG. 2B constitutes a partially exploded view in perspective of the underwater power unit 10 from FIG. 2A, according to some embodiments.
Figure 3:
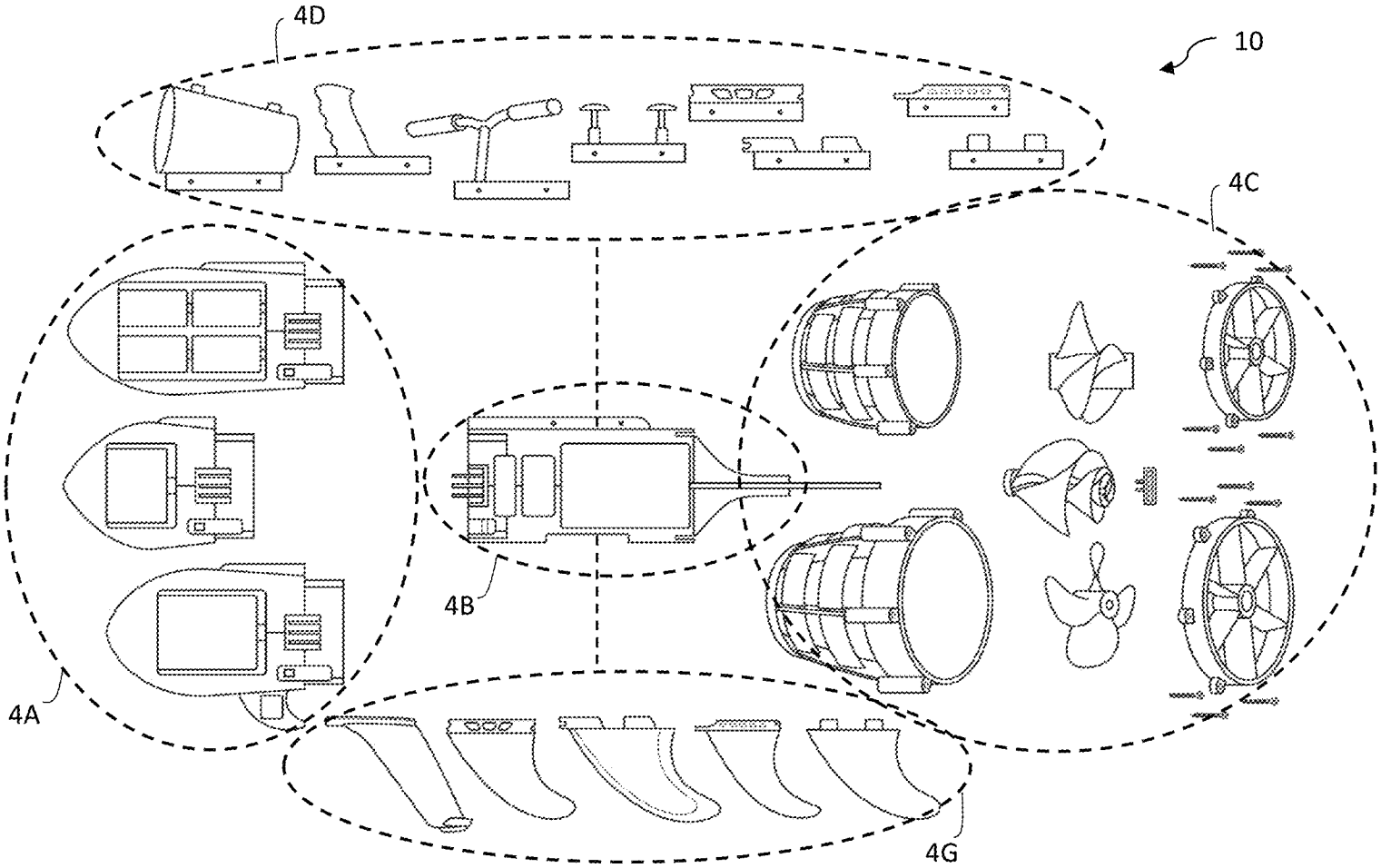
FIG. 3 constitutes an exploded view of underwater power unit 10, according to some embodiments.
Figure 4A:
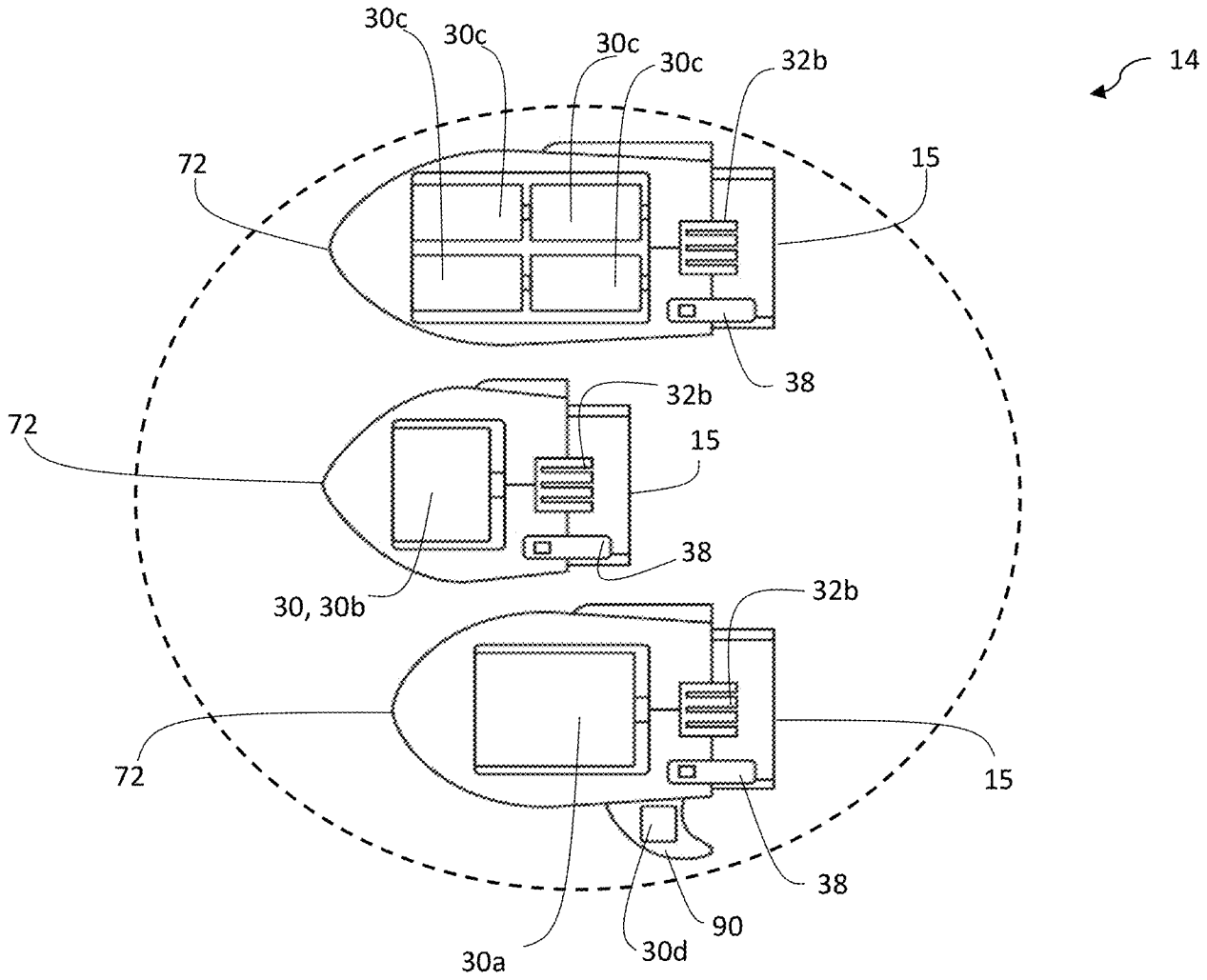
FIG. 4A constitutes a partial cross-sectional zoomed-in view of optional alternative power source housings 14 marked as region 4A in FIG. 3, according to some embodiments.
Figure 4B:
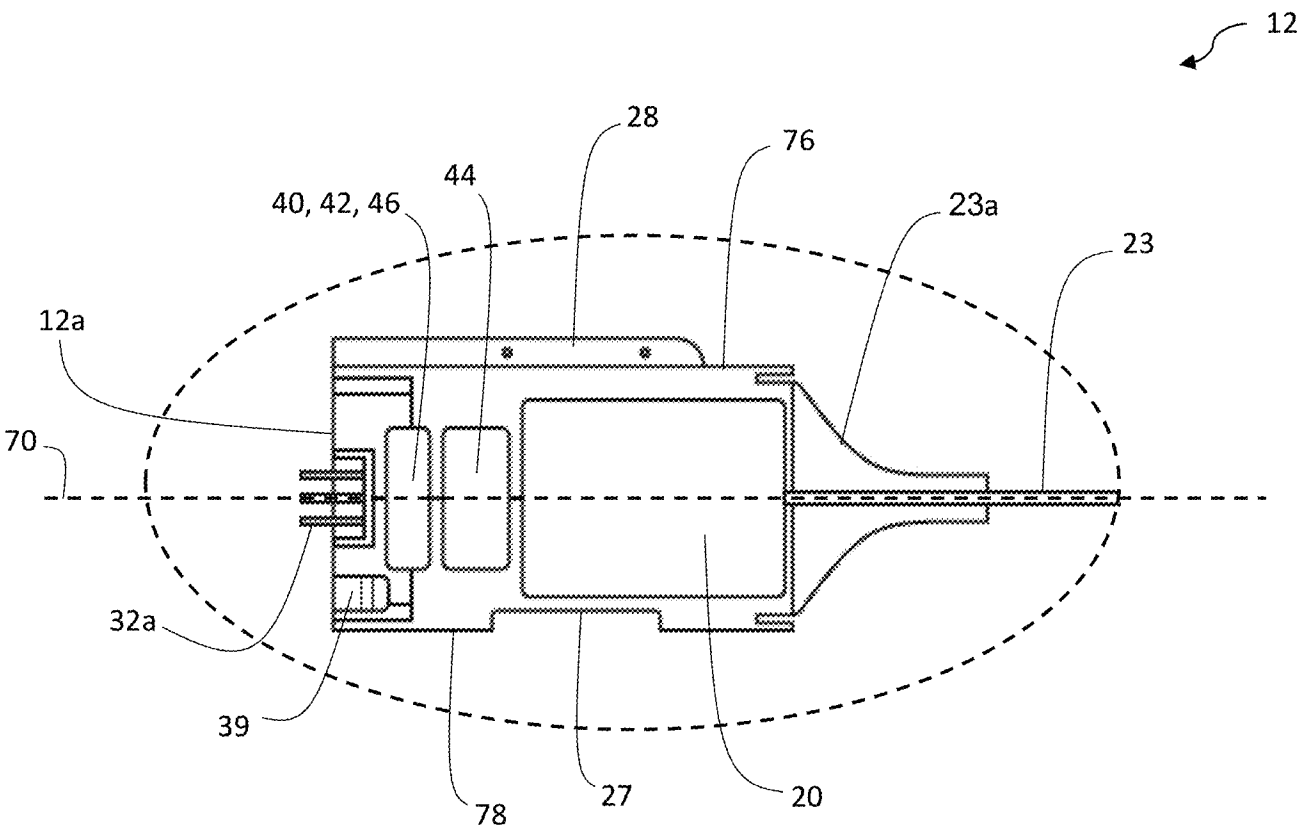
FIG. 4B constitutes a partial cross-sectional zoomed-in view of a main body 12 marked as region 4B in FIG. 3, according to some embodiments.
Figure 4C:
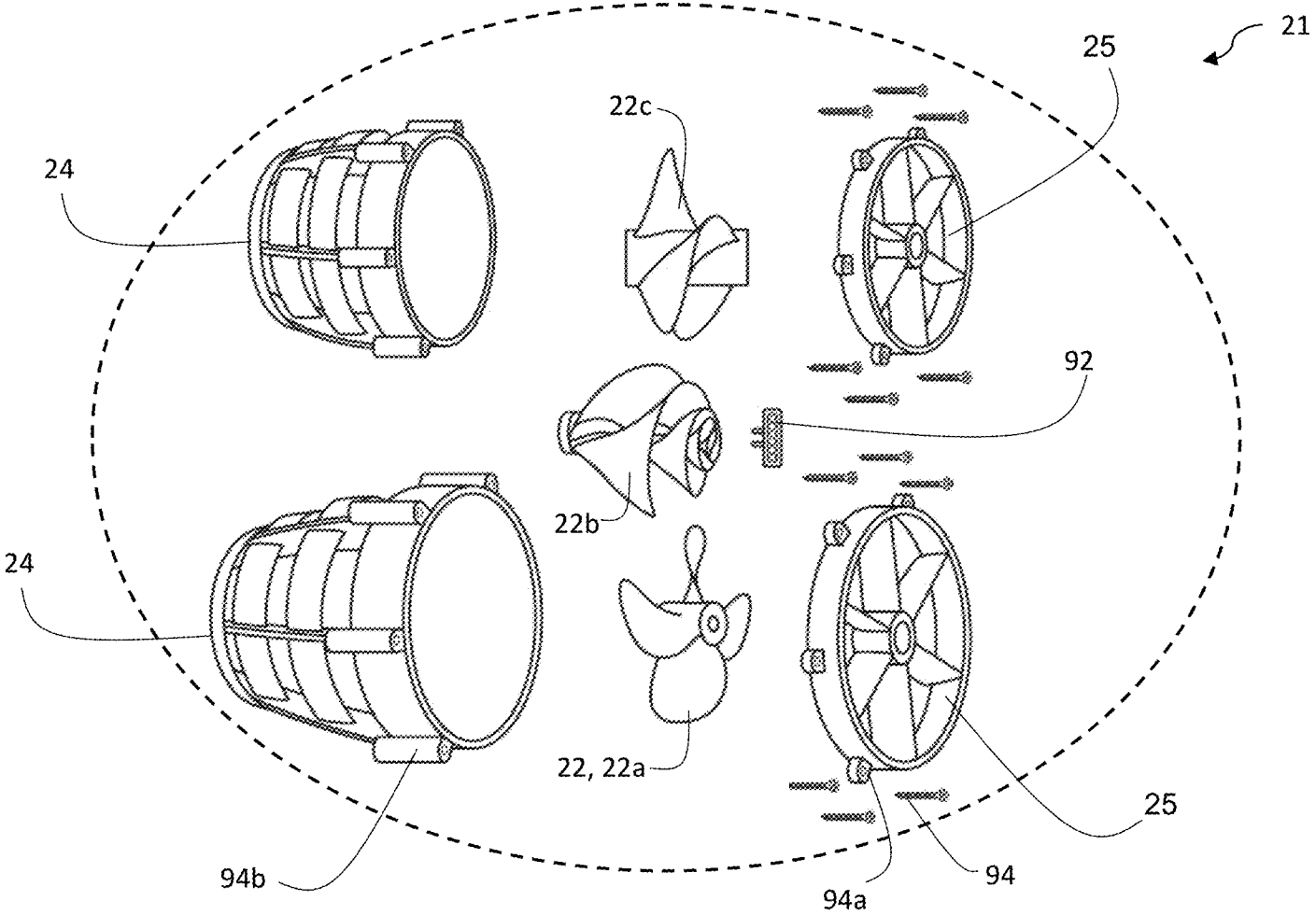
FIG. 4C constitutes a zoomed-in view of optional alternative rear units 21 marked as region 4C in FIG. 3, according to some embodiments.
Figure 4D:
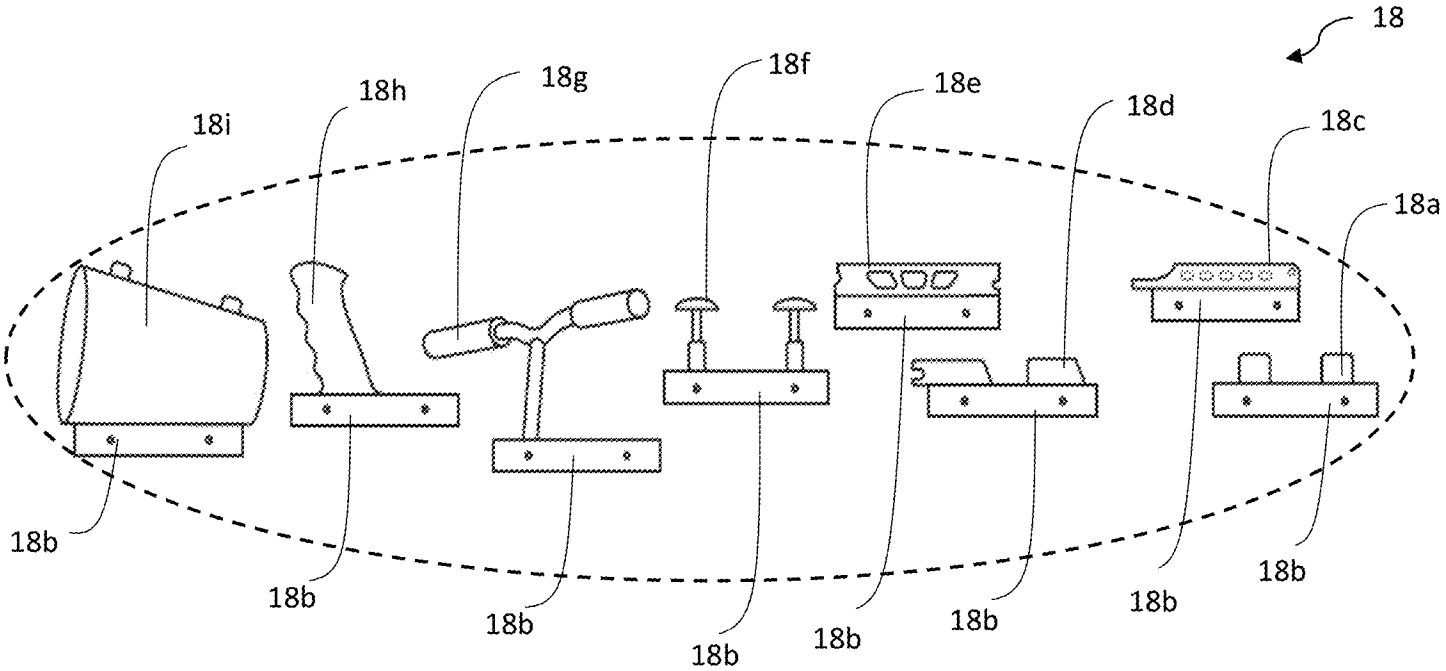
FIG. 4D constitutes a partial cross-sectional zoomed-in view of optional alternative adaptor units 18 marked as region 4D in FIG. 3, according to some embodiments.
Figure 4F:
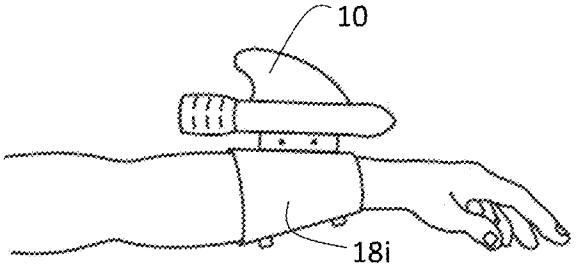
FIGS. 4E-4F constitute views in perspective of different configurations of underwater power unit 10, according to some embodiments.
Figure 4E:
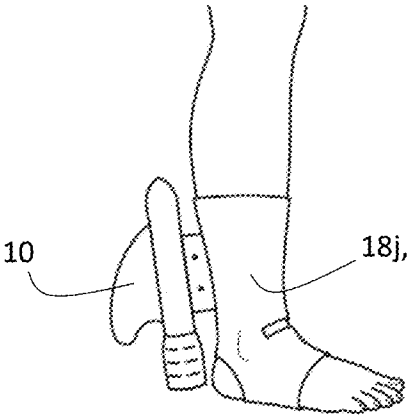
Figure 4G:
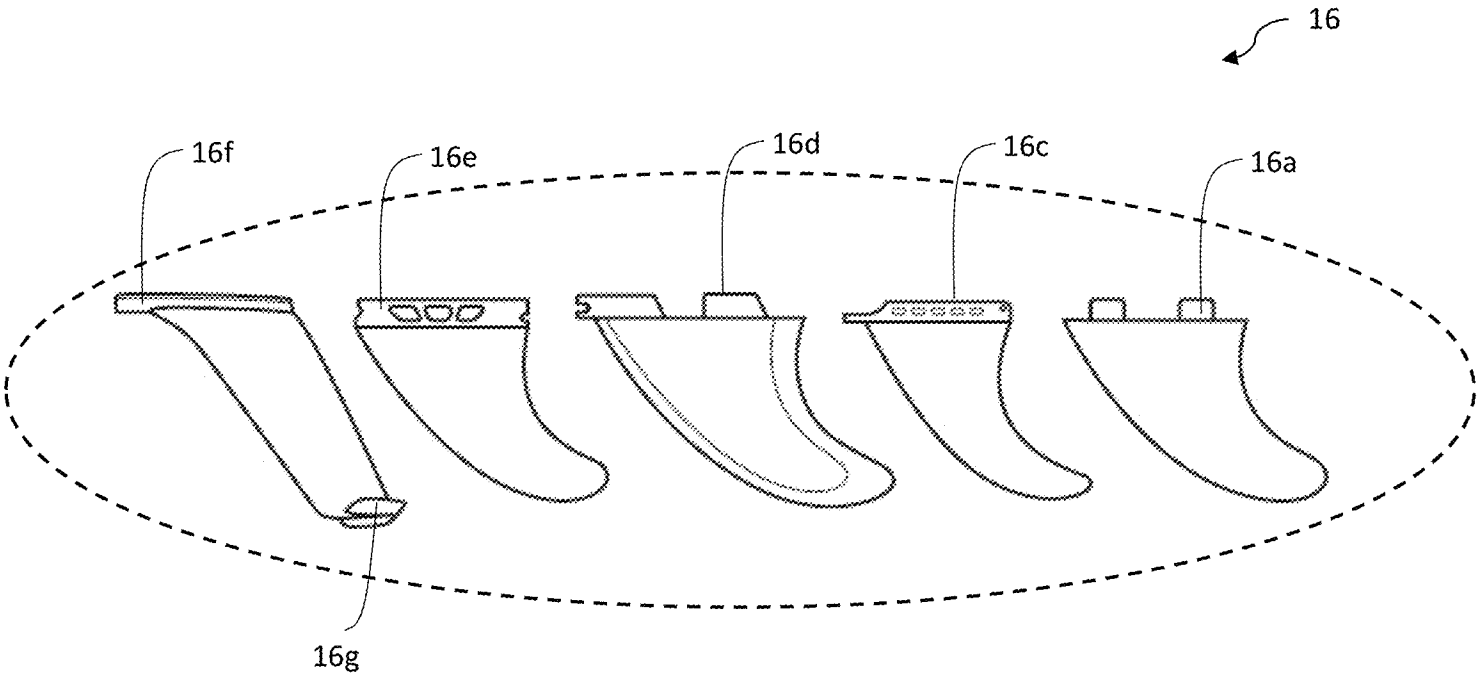
FIG. 4G constitutes a partial zoomed-in side view of optional alternative fin units 16 marked as region 4G in FIG. 3, according to some embodiments.
Figure 6:
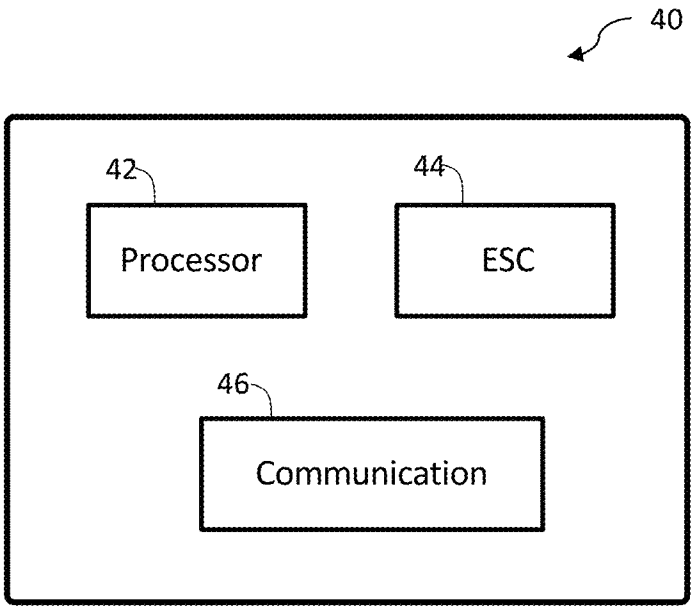
FIG. 6 constitutes a functional block diagram depicting a control unit 40 corresponding to different embodiments of the present invention.
Figure 5:
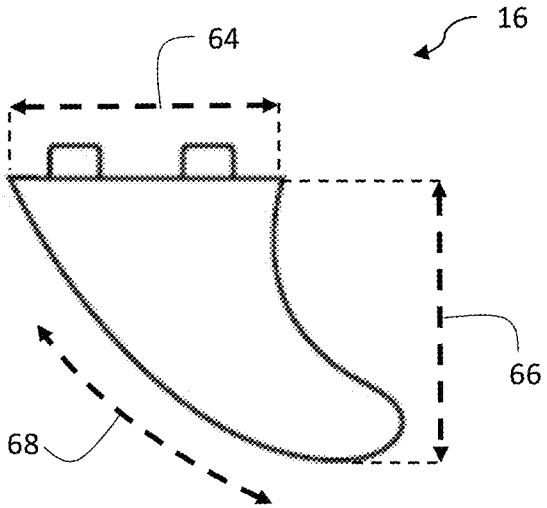
FIG. 5 illustrates various fin characteristics of fin unit 16, according to some embodiments.

Reference is now made to FIGS. 2A-6. FIG. 2A constitutes a view in perspective of underwater power unit 10, according to some embodiments. FIG. 2B constitutes a partially exploded view in perspective of the underwater power unit 10 from FIG. 2A. FIG. 3 constitutes an exploded view of underwater power unit 10, according to some embodiments. FIG. 4A constitutes a partial cross-sectional zoomed-in view of optional alternative power source housings 14 marked as region 4A in FIG. 3. FIG. 4B constitutes a partial cross-sectional zoomed-in view of a main body 12 marked as region 4B in FIG. 3. FIG. 4C constitutes a zoomed-in view of optional alternative rear units 21 marked as region 4C in FIG. 3. FIG. 4D constitutes a partial cross-sectional zoomed-in view of optional alternative adaptor units 18 marked as region 4D in FIG. 3. FIGS. 4E-4F constitute views in perspective of different configurations of underwater power unit 10, according to some embodiments. FIG. 4G constitutes a partial zoomed-in side view of optional alternative fin units 16 marked as region 4G in FIG. 3. FIG. 5 illustrates various fin characteristics of fin unit 16, according to some embodiments. FIG. 6 constitutes a functional block diagram of a control unit 40 corresponding to different embodiments of the present invention.

According to some embodiments, underwater power unit 10 is suitable for underwater applications. According to some embodiments, underwater power unit 10 comprises at least one material selected from metal, metal alloy, polymeric material (e.g., plastic), and combinations thereof. Each possibility represents a separate embodiment. According to some embodiments, underwater power unit 10 comprises a corrosion resist coating. According to some embodiments, underwater power unit 10 is waterproof.

According to some embodiments, underwater power unit 10 is configured to be waterproof to a depth of at least about 5 meters below the surface of the water. According to further embodiments, underwater power unit 10 is configured to be waterproof to a depth of at least about 10 meters, at least about 30 meters, at least about 50 meters, at least about 70 meters, or at least about 100 meters below the surface of the water. Each possibility represents a separate embodiment.

Reference is now made to FIGS. 2A-2B and 3. According to some embodiments, underwater power unit 10 extends from an underwater power unit front end 72 towards an underwater power unit rear end 74, along a central longitudinal axis 70. According to some embodiments, underwater power unit 10 comprises a plurality of modular parts, configured to be detachably attached to each other. According to some embodiments, underwater power unit 10 comprises a power source housing 14 comprising at least one power source 30 disposed within; a main body 12 comprising: an upper main body adaptor platform 28 configured to be detachably attached to an adaptor unit 18, a lower fin attachment section 27 configured to be detachably attached to a fin unit 16, and a motor 20 disposed within main body 12, wherein said motor 20 is configured to be coupled to a propeller 22 via a shaft 23; and a rear unit 21 encompassing said propeller 22 and a portion of said shaft 23.

According to some embodiments, lower fin attachment section 27 of main body 12 is integrally formed with fin unit 16. According to further embodiments, main body 12 is integrally formed with fin unit 16.

According to some embodiments, motor 20 is coupled to a propeller 22 via a shaft 23. According to some embodiments, shaft 23 extends from motor 20 in the distal direction 80 towards underwater power unit rear end 74. According to some embodiments, motor 20 is configured to be electronically coupled to the at least one power source 30. According to some embodiments, at least one of power source housing 14 and rear unit 21 is detachably attached to main body 12. According to some embodiments, power source housing 14 is detachably attached to main body 12. According to some embodiments, rear unit 21 is detachably attached to main body 12.

The term "distal", as used herein, refers to a rearward direction along the central longitudinal axis, for example towards the underwater power unit rear end 74.

According to some embodiments, power source housing 14 extends from an underwater power unit front end 72 towards a power source housing opening 15. According to some embodiments, main body 12 extends from a main body opening 12*a* towards rear unit 21. According to some embodiments, rear unit 21 extends from main body 12 towards an underwater power unit rear end 74.

According to some embodiments, main body 12 comprises a main body top surface 76 and a main body bottom surface 78, located at opposing external surfaces of main body 12. According to some embodiments, main body top surface 76 comprises upper main body adaptor platform 28. According to some embodiments, main body bottom surface 78 comprises the lower fin attachment section 27. According to some embodiments, upper main body adaptor platform 28 and lower fin attachment section 27 are located at opposing external surfaces of main body 12. According to some embodiments, upper main body adaptor platform 28 is substantially parallel to central longitudinal axis 70. According to some embodiments, fin attachment section is substantially parallel to central longitudinal axis 70.

The term "substantially parallel", as used herein, refers to elements or axes that may be angled relative to each other by up to 15 degrees.

According to some embodiments, power source housing 14 is aligned with main body 12 along the central longitudinal axis 70, when attached thereto, as illustrated at FIG. 2A. According to some embodiments, central longitudinal axis 70 extends through at least a portion of power source housing 14 and at least a portion of main body 12, when both are attached to each other. According to some embodiments, power source housing 14, main body 12, and rear unit 21 are aligned with each other along the central longitudinal axis 70, when attached thereto, as illustrated at FIG. 2A. According to some embodiments, central longitudinal axis 70 extends through at least a portion of power source housing 14, at least a portion of main body 12 and at least a portion of rear unit 21, when attached to each other.

Reference is now made to FIGS. 2B and 4A. According to some embodiments, power source housing 14 comprises at least one power source 30 disposed within, configured to be electronically connected, directly or indirectly, to motor 20 and to provide electric power thereto. According to some embodiments, at least one power source 30 is rechargeable. According to some embodiments, at least one power source 30 is a battery. According to some embodiments, at least one power source 30 is selected from: nickel cadmium (NiCd) battery, lithium-ion (Li-ion) battery, lithium-ion polymer (Li-ion polymer) battery, lead-acid battery, nickel-metal hydride (NiMH) battery, combination thereof, and other known batteries in the art. Each possibility represents a separate embodiment. According to some embodiments, at least one power source 30 is a rechargeable lithium-ion polymer battery.

The battery may have a voltage output selected from, but not limited to, 14.8 V, 18.5 V, 22.2 V, 25.9 V. Each possibility represents a different embodiment.

According to some embodiments, at least one power source 30 is characterized by having a power source length, along the central longitudinal axis 70, when connected to the main body 12. The at least one power source 30 may have various power source lengths, wherein each length corresponds to a different voltage output of a battery. According to some embodiments, at least one power source 30 comprises battery 30*a*. According to some embodiments, at least one power source 30 comprises battery 30*b*. The battery 30*a* may have a longer power source length compared to battery 30*b*, as illustrated at FIG. 4A, corresponding to a higher battery voltage output.

According to some embodiments, at least one power source 30 comprises a plurality of batteries. According to some embodiments, at least one power source 30 comprises a plurality of batteries 30*c*, as schematically illustrated at FIG. 4A. According to some embodiments, at least one power source 30 comprise at least two, at least three, at least four, at least five, at least six, at least eight, or at least ten batteries 30*c*. According to some embodiments, at least one power source 30 comprise a plurality of rechargeable lithium-ion polymer batteries 30*c*. According to further embodiments, power source housing 14 comprises a plurality of rechargeable lithium-ion polymer batteries 30*c*.

According to some embodiments, power source housing 14 further comprises at least one additional battery 30*d*, as illustrated at FIG. 4A. The at least one additional battery 30*d* can be identical or different from the at least one power source 30. According to some embodiments, at least one additional battery 30*d* is identical to at least one of: battery 30*a*, battery 30*b*, or battery 30*c*. According to some embodiments, at least one additional battery 30*d* is disposed within a power source housing fin 90, wherein said power source housing fin 90 is located at an external surface of power source housing 14. According to some embodiments, at least one additional battery 30*d* is configured to be electronically connected, directly or indirectly, to motor 20 and to provide electric power thereto, in addition to at least one power source 30. Without wishing to being bound by any theory of mechanism of action, it is contemplated that the power source housing fin 90 does not hinder of affect the hydrodynamic movement of underwater power unit 10 during operation thereof.

According to some embodiments, the present invention provides a plurality of power source housings 14 configured to be detachably attached to main body 12, wherein each power source housing 14 comprises at least one power source 30 disposed within, wherein each at least one power source 30 is a rechargeable battery having a different voltage output. According to further embodiments, the present invention provides a plurality of power source housings 14 configured to be detachably attached to main body 12, wherein each power source housing 14 comprises a different battery configuration, having a different number of batteries disposed within.

Advantageously, the user can select a power source housing 14 having a specific battery configuration suitable to the user's requirements during surfing. Therefore, the user can purchase a single underwater power unit 10 with optionally several types of power source housings 14, each having a different voltage output, suitable to the requirements of various users. For example, it is possible that a beginner user will require a configuration of a heavy and large power source housing 14 optionally having a plurality of batteries or a single battery having a high voltage output for excessive assistance during surfing, while an experienced user will require a configuration of a light and small power source housing 14 having one battery having a low voltage output for modest assistance during surfing, that will not affect the hydrodynamic movement of the surfboard.

According to some embodiments, power source housing 14 further comprises a nose cap 34 located at underwater power unit front end 72, as illustrated at FIG. 2B. According to some embodiments, nose cap 34 is integrally formed with power source housing 14. According to some embodiments, the nose cap 34 may be affixed to power source housing 14, for example via application of suitable attachment materials, such as glues, resins, pastes and the like. According to some embodiments, nose cap 34 is detachably attached to power source housing 14. The nose cap 34 may be detachably attached to power source housing 14 through a fastening mechanism such as, but not limited to, snap-fit fastener mechanism, bayonet mount, screw fittings, or any structural mechanism similar thereto. Each possibility represents a separate embodiment of the present invention. According to some embodiments, nose cap 34 comprises a threaded surface and is configured to threadedly engage with power source housing 14 (not shown). Advantageously, at least one power source 30 can be easily inserted into and/or removed from power source housing 14 by the detachment of nose cap 34, without any structural modifications made to power source housing 14.

According to some embodiments, nose cap 34 is shaped as a nose cone. Advantageously, the shape of nose cap 34 is a hydrodynamically efficient shape, configured to facilitate the adequate underwater movement of underwater power unit 10 with minimal water resistance. However, it is to be understood that nose cap 34 fulfills the same function and maintains its hydrodynamic qualities when otherwise shaped, as a simple cone, spherically blunted cone, tangent ogive, elliptical cone, spherically blunted tangent ogive, parabolic nose cone, combinations thereof, or any other polyhedron. Each possibility represents a separate embodiment of the present invention. In some embodiments, the cross-sectional shape of nose cap 34 is dome-shaped. It is to be understood, however, that the cross-sectional geometry of nose cap 34 may be of a different shape, such as a circular, triangular or any other curvilinear or rectilinear cross-section, as long as said shape maintains the hydrodynamic qualities of nose cap 34. Each possibility represents a separate embodiment of the present invention.

According to some embodiments, power source housing 14 further comprises a first power connector 32*b* disposed within, extending from the at least one power source 30 in a distal direction 80, and configured to be electronically coupled to a second power connector 32*a*, wherein the second power connector 32*a* is disposed within main body 12, as illustrated at FIG. 2B. According to some embodiments, first power connector 32*b* is configured to transfer electric power from at least one power source 30 to second power connector 32*a*, during the attachment of power source housing 14 to main body 12. According to further embodiments, to second power connector 32*a* is configured to transfer said electric power, directly or indirectly, to motor 20.

According to some embodiments, first power connector 32*b* is attached to power source housing 14 utilizing a circumferential seal member (not shown), configured to provide waterproof sealing of the first power connector 32*b* thereto, thereby preventing water from entering into the interior of power source housing 14. According to some embodiments, second power connector 32*a* is attached to main body 12 utilizing a circumferential seal member (not shown), configured to provide waterproof sealing of the second power connector 32*a* thereto, thereby preventing water from entering into the interior of main body 12. The circumferential seal members can be a waterproof O-ring, or other known waterproof seal members known in the art. It is to be understood, that all of the sealing means or members within the scope of the present invention are waterproof.

First power connector 32*b* and second power connector 32*a* may comprise additional components and circuitry not shown in FIGS. 2B and 4A. According to some embodiments, first power connector 32*b* and second power connector 32*a* are waterproof. According to some embodiments, first power connector 32*b* is a female type connector, as illustrated at FIG. 4A. According to some embodiments, first power connector 32*b* is a male type connector (not shown).

According to some embodiments, power source housing 14 is detachably attached to main body 12. According to some embodiments, power source housing opening 15 is configured to interact with or to be attached to a main body opening 12*a*. According to some embodiments, power source housing opening 15 is configured to enter to main body opening 12*a*. According to some embodiments, power source housing 14 is detachably attached to main body 12 by various releasable mechanisms such as but not limited to, snap-fit fastener, bayonet mount, latch, or any structural mechanism similar thereto. Each possibility represents a separate embodiment of the present invention. According to some embodiments, the snap-fit fastener is selected from an annular snap-fit, a torsional snap fit, a cantilever snap-fit, a U-shaped cantilever snap-fit, an L-shaped cantilever snap-fit, or any structural mechanism similar thereto. Each possibility represents a separate embodiment of the present invention. According to some embodiments, the snap-fit fastener is a cantilever snap-fit.

According to some embodiments, power source housing 14 comprise at least one coupling arm 38. According to some embodiments, power source housing 14 comprise at least two coupling arms 38. According to some embodiments, at least two coupling arms 38 are located at opposite external surfaces of power source housing 14, extending in distal direction 80 towards power source housing opening 15. According to some embodiments, at least two coupling arms 38 are integrally formed with power source housing 14. According to some embodiments, at least two coupling arms 38 are connected to power source housing 14 by a hinge, a spring, or any other known flexible and/or elastic element known in the art.

According to some embodiments, main body 12 comprises at least one coupling recess 39. According to some embodiments, main body 12 comprises at least two coupling recesses 39. According to some embodiments, at least two coupling recesses 39 are located at opposite external surfaces of main body 12, in the vicinity of main body opening 12*a*. According to some embodiments, at least two coupling recess 39 are integrally formed with main body 12.

According to some embodiments, at least two coupling arms 38 are configured to engage with at least two coupling recess 39. The engagement of at least two coupling arms 38 with at least two coupling recess 39 form a releasable engagement mechanism. The releasable engagement mechanism has a released position, shown in FIG. 2B, and a locked position, shown in FIG. 2A. In the released position, power source housing 14 and main body 12 are separated and the releasable engagement mechanism is not engaged. In the locked position, power source housing 14 is joined to main body 12 and the releasable engagement mechanism is engaged. According to some embodiments, the releasable engagement mechanism comprises a snap-fit mechanism.

In operation, power source housing 14 is joined to main body 12 by positioning them along central longitudinal axis 70, such that each one of coupling arms 38 is aligned with each one of coupling recess 39. FIG. 2B illustrates the proper alignment of at least two coupling arms 38 with at least two coupling recess 39. According to some embodiments, power source housing 14 comprise a plurality of coupling arms 38 and main body 12 comprises a corresponding plurality of coupling recess 39. In operation of such embodiments, power source housing 14 is joined to main body 12 by aligning the plurality of coupling arms 38 with the corresponding plurality of coupling recess 39.

According to some embodiments, the releasable engagement mechanism of coupling arms 38 with coupling recess 39 is configured to be repeatedly engaged and released without sacrificing the ability of the releasable engagement mechanism to securely join power source housing 14 to main body 12. According to some embodiments, the releasable engagement mechanism of coupling arms 38 with coupling recess 39 is configured to be waterproof, thereby preventing the entry of water from the joined connection between power source housing 14 and main body 12.

According to some embodiments, power source housing 14 comprises at least two coupling recesses 39 and main body 12 comprises at least two coupling arms 38 (not shown), wherein the at least two coupling arms 38 are configured to engage with the at least two coupling recesses 39, thereby attaching power source housing 14 to main body 12. It is to be understood that the engagement of at least two coupling arms 38 with at least two coupling recesses 39 form the releasable engagement mechanism, regardless of the location of the coupling arms 38 and the respective coupling recesses 29, is as described herein.

The releasable engagement mechanism of coupling arms 38 with coupling recess 39 can be easily and swiftly engaged and/or released, in order to permit easy and rapid disassembly of power source housing 14 from main body 12. Such an easy and rapid disassemble and engagement capabilities are highly useful during surfing away from shore. It is to be understood that the releasable engagement mechanism as presented herein does not utilize any additional separate fastening means, such as bolts or screws, or a threaded configuration such as threading power source housing 14 into main body 12, which might consume a significantly longer time to perform a power source housing 14 replacement procedure. Advantageously, the lack of additional separate complex fastening means or a threaded configuration contributes for the easy and rapid disassemble and engagement of power source housing 14 from main body 12 during surfing away from shore.

During surfing, the user can carry (for example, using a pouch or a bag) at least one additional power source housing 14 containing a fully charged at least one power source 30. If the at least one power source 30 within the presently connected power source housing 14 is discharged or depleted during surfing, the user can easily release it from main body 12 utilizing the releasable engagement mechanism and replace it with a new power source housing 14 containing a fully charged at least one power source 30. Due to the simplicity of utilizing the releasable engagement mechanism as described herein above, the user can quickly resume surfing, without remaining stranded in water for prolonged durations in order to replace the power source using more complex fastening means or a time-consuming threaded configuration.

According to some embodiments, since all of the sealing means or members within the scope of the present invention are waterproof, the rapid disassembly and engagement of power source housing 14 from and to main body 12 in the environment of water or underwater, cannot harm or damage the inner electric components of power source housing 14 and main body 12. According to some embodiments, the releasable engagement mechanism is waterproof, thereby enabling the detachable attachment of power source housing 14 from main body 12 in the environment of water or underwater. Advantageously, the safe and rapid disassembly and engagement of power source housing 14 from and to main body 12 in the environment of water or underwater allow the user to replace a depleted power source housing 14 while surfing and/or diving away from shore, thereby providing the user with a time and effort saving underwater power unit 10 and preventing the need to paddle back to shore in order to change the depleted power source.

Reference is now made to FIGS. 2B and 4B. According to some embodiments, main body 12 comprises motor 20 disposed within, coupled or couplable to propeller 22 via shaft 23. According to some embodiments, shaft 23 extends from motor 20 in the distal direction 80 towards underwater power unit rear end 74. According to some embodiments, motor 20 is configured to provide a thrusting force to drive or propel the underwater power unit 10 forward (in the direction opposite to the distal direction 80). In some embodiments, motor 20 is disposed within main body 12. According to some embodiments, motor 20 is configured to generate a rotation of propeller 22 about the central longitudinal axis 70.

According to some embodiments, main body 12 further comprises a shaft circumferential cover 23*a*, encompassing at least a portion of shaft 23, as illustrated at FIG. 4B. According to some embodiments, shaft circumferential cover 23*a* is configured to encompass and support at least a portion of shaft 23, and thereby to provide mechanical stability thereto. According to some embodiments, shaft circumferential cover 23*a* is attached to main body 12, and extends in the distal direction 80 towards underwater power unit rear end 74. According to some embodiments, shaft circumferential cover 23*a* is waterproof, and is further configured to seal main body 12, thereby preventing water from entering thereto.

According to some embodiments, motor 20 is supported within main body 12 by a plurality of struts, extending from an inner surface of main body 12 (not shown).

Motor 20 can be an electric motor. According to some embodiments, motor 20 is selected from a permanent magnet DC (direct current) motor, a brushless motor, a brushed motor, a switched reluctance motor, a synchronous reluctance motor, an induction motor and a universal motor. Each possibility represents a separate embodiment of the present invention. According to some embodiments, motor 20 is a brushless DC electric motor. According to some embodiments, at least one power source 30 is configured to provide power to motor 20 in order to rotate propeller 22, thereby to propel or drive underwater power unit 10 forward, in the direction opposite to the distal direction 80. According to some embodiments, motor 20 is configured to impart rotational movement to propeller 22. The voltage output of at least one power source 30 directly affect the continuous operation and the thrust force of motor 20.

According to some embodiments, motor 20, via propeller 22, is configured to propel or drive standard surfboard 2 and the user forward at a speed of about 1 to about 30 km/h. According to further embodiments, motor 20 is configured to propel standard surfboard 2 and the user at a speed of about 1 to about 15 km/h. According to further embodiments, motor 20 is configured to propel standard surfboard 2 and the user at a speed of about 1 to about 10 km/h. According to further embodiments, motor 20 is configured to propel standard surfboard 2 and the user at a speed of about 1 to about 8 km/h. According to some embodiments, motor 20 is configured to propel standard surfboard 2 and the user at a speed of at least about 5 km/h.

According to some embodiments, at least one power source 30 is configured to provide at least one hour of continuous operation of motor 20. According to further embodiments, at least one power source 30 is configured to provide at least two hours, at least three hours, at least four, at least five, or at least ten hours of continuous operation of motor 20. Each possibility represents a separate embodiment of the present invention. According to further embodiments, at least one power source 30 is configured to provide at least two hours of continuous operation of motor 20.

According to some embodiments, motor 20 is configured to rotate propeller 22 at about 500 to about 50,000 rounds per minute (RPM). According to some embodiments, motor 20 is configured to rotate propeller 22 at about 1,000 to about 25,000 rounds per minute (RPM). According to some embodiments, motor 20 is configured to rotate propeller 22 at a variety of rotational speed ranges, depending on the requirements of the user during the different stages of surfing. According to some embodiments, motor 20 is configured to rotate propeller 22 at a high rotational speed for a short time duration, such as about 1-20 seconds, in order to assist the user to accelerate the surfboard in order to properly "catch a wave", thereby providing the user with a "power boost" (i.e., high speed for a short time). According to some embodiments, motor 20 is configured to rotate propeller 22 at a low rotational speed for a long-time duration, such as about 10 seconds to about 10 minutes, in order to assist the user to paddle out away from the shore against the flow direction of the waves. The high rotational speed can refer to about 10,000 to about 25,000 RPM, while the low rotational speed can refer to about 1,000 to about 10,000 RPM.

According to some embodiments, main body 12 comprises upper main body adaptor platform 28, located at main body top surface 76. According to some embodiments, upper main body adaptor platform 28 is integrally formed with main body 12. According to some embodiments, upper main body adaptor platform 28 is configured to be detachably attached to adaptor unit 18. According to some embodiments, upper main body adaptor platform 28 is configured to interact with, or to receive an adaptor coupling surface 18*b* of adaptor unit 18, as illustrated at FIG. 2B. According to some embodiments, upper main body adaptor platform 28 comprises a female type elongated opening or slot, adapted to receive a male type adaptor coupling surface 18*b*, as shown in the exemplary embodiment illustrated in FIG. 2B. According to some embodiments, upper main body adaptor platform 28 comprises a vertical extension, extending upwards from main body top surface 76, wherein said vertical extension comprises a female type slot disposed therein, adapted to receive the male type adaptor coupling surface 18*b*, as shown in the exemplary embodiment illustrated in FIG. 4B.

According to some embodiments, adaptor coupling surface 18*b* is configured to be secured to upper main body adaptor platform 28 utilizing attachment means, such as bolts, screws, set screws, nails, pins, latches, snap-fit fasteners, bayonet mounts, and other attachment means known in the art. Each possibility represents a separate embodiment.

According to some embodiments, main body 12 comprises lower fin attachment section 27 located at main body bottom surface 78 and configured to be detachably attached to fin unit 16. According to some embodiments, lower fin attachment section 27 comprises a standard slot, as described herein above. According to some embodiments, said standard slot is integrally formed with main body 12. According to further embodiments, the standard slot is configured to be detachably attached to a standard fin. According to some embodiments, the standard slot is selected from FCS fin box, FCS II fin box, futures fin box, and other fin boxes known in the art. Each possibility represents a separate embodiment. According to some embodiments, lower fin attachment section 27 is configured to secure various standard fins types utilizing a compatibility adaptor or a fin adaptor.

Reference is now made to FIGS. 4B and 6. According to some embodiments, main body 12 further comprises a control unit 40. According to some embodiments, control unit 40 is in electrical and/or functional communication with at least one of power source 30 and motor 20. According to some embodiments, control unit 40 comprises at least one processor 42 configured to send and receive data (such as, but not limited to, digitized signals, control data, etc.) to and from the various electronic components of underwater power unit 10. At least one processor 42 can be selected from, but not limited to, a microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable device or a combination of devices that can perform calculations or other manipulations of information. Each possibility represents a separate embodiment.

The term "processor", as used herein, refers to a single chip device which includes a plurality of modules which may be collected onto a single chip in order to perform various computer-related functions.

According to some embodiments, control unit 40 further comprises at least one of an electronic speed control unit 44 (ESC) and a communication module 46. According to some embodiments, control unit 40 further comprises an electronic speed control unit 44 (ESC) and a communication module 46, wherein each one is in functional communication with at least one processor 42. According to some embodiments, each one of processor 42, electronic speed control unit 44, and communication module 46 are mounted on at least one printed circuit board (PCB). According to some embodiments, each one of processor 42, electronic speed control unit 44, and communication module 46 are mounted on the same PCB. According to some embodiments, communication module 46 is embedded within processor 42.

As used herein, the terms "electronic speed control" and "ESC" are interchangeable, and refer to an electronic circuit that controls and regulates the speed of motor 20. According to some embodiments, electronic speed control unit 44 is embedded within processor 42. According to some embodiments, electronic speed control unit 44 is separate from processor 42.

According to some embodiments, communication module 46 comprises electronic communication systems and methods, including a wireless link. Said wireless link can incorporate any suitable wireless connection technology known in the art, including but not limited to NFC, Wi-Fi (IEEE 802.11), Bluetooth, other radio frequencies, Infra-Red (IR), GSM, CDMA, GPRS, 3G, 4G, W-CDMA, EDGE or DCDMA200 and similar technologies. Each possibility represents a separate embodiment of the present invention. According to some embodiments, communication module 46 further comprises a radio-frequency (RF) antenna.

According to some embodiments, communication module 46 further comprises at least one of a transmitter module and/or a receiver module. According to some embodiments, communication module 46 is configured to perform wireless communication utilizing Bluetooth.

According to some embodiments, control unit 40 is substantially aligned with motor 20 within main body 12, along the central longitudinal axis 70. According to some embodiments, processor 42, communication module 46 and electronic speed control unit 44 are substantially aligned with motor 20 within main body 12, along the central longitudinal axis 70, as illustrated at FIG. 4B. According to some embodiments, central longitudinal axis 70 extends through at least a portion of control unit 40 and at least a portion of motor 20. According to some embodiments, central longitudinal axis 70 extends through at least a portion of processor 42, at least a portion of electronic speed control unit 44, at least a portion of communication module 46, and at least a portion of motor 20. According to some embodiments, the alignment of processor 42, communication module 46, electronic speed control unit 44, and motor 20 along the central longitudinal axis 70 during the manufacturing of underwater power unit 10, enables lower fin attachment section 27 to comprise the standard slot which is able to be detachably attached to the standard fin.

According to some embodiments, main body 12 further comprises at least one waterproof control switch (not shown). According to some embodiments, said control switch in the form of an on/off push button switch. As used herein, the terms "on/off push button switch" or "push button switch" are interchangeable, and refers to a two-position, 'on/off' switch mechanism, wherein a first press of the push button switch actuates the switch from 'off' to 'on' and activates the various components of underwater power unit 10, while a second press of the push button switch turns the switch back 'off' and deactivates the various components thereof.

According to some embodiments, upon the first press of the push button switch, the various components of underwater power unit 10 are activated, and motor 20 starts to rotate propeller 22, until reaching a predetermined rotation speed. According to some embodiments, motor 20 is configured to maintain said predetermined rotation speed until the second press of the push button switch, which deactivates the various electronic components thereof. According to some embodiments, main body 12 further comprises at least one additional waterproof switch, wherein the press of said switch is configured to change the predetermined rotation speed within a predetermined rotation range. According to some embodiments, the user can select or define the predetermined rotation speed and/or the predetermined rotation range prior to, or during, surfing.

According to some embodiments, main body 12 further comprises at least one waterproof visual indicator (not shown). According to some embodiments, the visual indicator comprises a display screen. According to some embodiments, the visual indicator comprises at least one LED lamp. The visual indicator can provide a visual indication for the activation or deactivation of underwater power unit 10, and optionally the rotational speed of propeller 22.

According to some embodiments, a remote device (not shown) is used to send wireless commands to communication module 46 through the wireless link. According to some embodiments, communication module 46 is configured to transfer said commands to processor 42. According to some embodiments, processor 42 is configured to receive the commands from communication module 46, and to control the activation of motor 20. According to some embodiments, processor 42 is configured to receive the commands from communication module 46, and in response thereto activate or deactivate motor 20, and control the rotational speed of motor 20. According to some embodiments, processor 42 is configured to receive the commands from communication module 46, and to communicate with the at least one power source 30, in order to control the supply of power to motor 20.

According to some embodiments, processor 42 is configured to receive the commands from communication module 46, and to communicate with electronic speed control unit 44, in order to control the activation of motor 20 and regulate the rotational speed of propeller 22. According to some embodiments, electronic speed control unit 44 is configured to receive commands from processor 42 or from communication module 46, and to regulate the electric power transferred from at least one power source 30 to motor 20, in order to control the rotational speed of propeller 22.

According to some embodiments, processor 42 is further configured to receive signals from at least one of: electronic speed control unit 44, motor 20, and at least one power source 30, and to transfer said signals to communication module 46. According to some embodiments, communication module 46 is configured to transfer said signals to the remote device through the wireless link. Said signals can include at least one of: the condition of motor 20, the condition of at least one power source 30, and the current rotational speed of propeller 22. The condition of at least one power source 30 can include the battery's discharge status.

According to some embodiments, the communication between each one of processor 42, communication module 46 and electronic speed control unit 44 is performed by wired or wireless communication. According to some embodiments, the communication between each one of processor 42, communication module 46, electronic speed control unit 44, motor 20, and at least one power source 30 is performed by wired or wireless communication. The wired communication can be one or more wire traces on a PCB.

The term "remote device", as used herein, refers to a device which supports wireless communication (utilizing a wireless link), that enable wireless communication with communication module 46 of underwater power unit 10. The remote device is able to send wireless commands to, and optionally receive signals from, control unit 40 of underwater power unit 10. The remote device can be selected from, but not limited to, a cell phone, a smartphone, a tablet, a smart-watch, a laptop, or a designated device. An application can be installed on at least one of said smartphone, tablet, laptop, and smart-watch, in order to control the wireless communication with control unit 40 of underwater power unit 10.

The term "designated device", as used herein, refers to a remote device that is manufactured specifically to control underwater power unit 10 as presented herein, and can be sold together with underwater power unit 10, or separately. According to some embodiments, the designated device comprises at least one of: a button, a touch screen and/or a display screen. Each possibility represents a separate embodiment. According to some embodiments, the designated device comprises a plurality of buttons. According to some embodiments, the designated device is fastened to the body of the user utilizing various wrapping means. The term "wrapping means", as used herein, refers to any elongated flexible structure known in the art, capable of being wrapped and unwrapped around any limb or portion of the body of a user, such as a strap, a band, a belt, a cord, a cable, a pouch, a chain and the like. The designated device can be worn on the wrist of the user, similar to a watch. The designated device can be worn on the neck of the user, similar to a neckless. The designated device can be worn on the waist of the user, similar to a pouch.

According to some embodiments, second power connector **32*a* is a male type connector, as illustrated at FIG. 4B. According to some embodiments, second power connector 32*a*** is a female type connector (not shown).

Reference is now made to FIGS. 2B and 4C. According to some embodiments, rear unit 21 comprises a protective cowling 24, extending from main body 12 in the distal direction 80 towards underwater power unit rear end 74. According to some embodiments, rear unit 21 encompasses or encircles propeller 22 and at least a portion of shaft 23. According to some embodiments, rear unit 21 further comprises a rear barrier 25, attached to protective cowling 24 at underwater power unit rear end 74. According to some embodiments, shaft 23 extends from motor 20 in the distal direction 80 towards rear barrier 25. According to some embodiments, shaft 23 extends from a first shaft end in the distal direction 80 towards a second shaft end (not shown). According to further embodiments, the second shaft end is in contact with rear barrier 25.

The term "protective cowling" as used herein, refers to a cage-like structure encompassing propeller 22. According to some embodiments, protective cowling 24 and rear barrier 25 are configured to prevent accidental contact between propeller 22 and the user, thus maintaining the safety of the user, while allowing free flow of water therethrough and the proper functioning of propeller 22. Protective cowling 24 and rear barrier 25 can be also configured to prevent accidental contact between propeller 22 and the external environment, such as but not limited to, fish and optionally sand. According to some embodiments, protective cowling 24 is waterproof sealed to main body 12, thereby preventing water from entering into the interior of main body 12.

In some embodiments, rear barrier 25 can include an outer ring having a diameter that closely matches the diameter of the rear end of protective cowling 24, and a plurality of ribs extending radially therefrom towards an inner ring, wherein the inner ring is configured to accept a second shaft end there-through, Reference is now made to FIG. 4C. According to some embodiments, rear unit 21 further comprises at least one bearing 92. According to some embodiments, at least one bearing 92 is disposed between the second shaft end of shaft 23 and rear barrier 25. According to some embodiments, at least one bearing 92 is configured to connect the second shaft end of shaft 23 to rear barrier 25 while maintaining/supporting the rotational movement of shaft 23. According to some embodiments, at least one bearing 92 comprises a rolling bearing selected from ball bearing and roller bearing. The roller bearing can be selected from, but not limited to, cylindrical roller, spherical roller, gear bearing, tapered roller, needle roller, and CARB toroidal roller bearing. Each possibility represents a separate embodiment of the present invention. According to some embodiments, at least one bearing 92 comprises a journal bearing.

According to some embodiments, propeller 22 comprises at least one blade. According to some embodiments, propeller 22 comprises a plurality of blades. According to some embodiments, propeller 22 comprises at least 2 blades, at least 3 blades, at least 4 blades, at least 5 blades, or at least 6 blades. Each possibility represents a separate embodiment. Propeller 22 can be selected from a fixed-pitch propeller (FPP), a controllable-pitch propeller (CPP), or other known propellers in the art. According to some embodiments, propeller 22 comprises various blade configurations, as illustrated at FIG. 4C. According to some embodiments, propeller 22 comprises various blade dimensions and shapes. According to some embodiments, propeller 22 comprises propeller 22*a* provided with a plurality of blades, such as the illustrated four blades. According to some embodiments, propeller 22 comprises propeller 22*b* having helical-blades formed in a tapering configuration (such as for example, a Lily impeller). According to some embodiments, propeller 22 comprises propeller 22*c* having helical or diagonal blades formed in a non-tapering configuration.

According to some embodiments, the various blade shapes and/or dimensions of propeller 22 affect the underwater power unit 10 hydrodynamic characteristics, thrust abilities, and user stability.

According to some embodiments, the underwater power unit 10 may be provided as a kit with a plurality of propellers 22, wherein each one comprises a different blade shape and/or dimensions. According to some embodiments, the underwater power unit 10 may be provided as a kit with a plurality of protective cowlings 24 and a corresponding plurality of rear barriers 25, each one is characterized by having different dimensions, as illustrated at FIG. 4C. According to further embodiments, the dimensions of each one of the plurality of protective cowlings 24 and corresponding plurality of rear barriers 25 correspond to the dimensions of each one of the plurality of propellers 22.

According to some embodiments, rear unit 21 is detachably attached to main body 12. According to some embodiments, protective cowling 24 is detachably attached to main body 12. According to some embodiments, rear barrier 25 is detachably attached to protective cowling 24. According to some embodiments, propeller 22 is detachably attached to shaft 23.

According to some embodiments, protective cowling 24 is configured to be detachably attached to main body 12 utilizing attachment means such as bolts, screws, set screws, nails, pins, latches, snap-fit fasteners, bayonet mounts, and other attachment means known in the art. Each possibility represents a separate embodiment. According to some embodiments, protective cowling 24 is configured to threadedly engage with main body 12 utilizing a threaded configuration (embodiments not shown).

According to some embodiments, rear barrier 25 is configured to be detachably attached to protective cowling 24 utilizing attachment means such as bolts, screws, set screws, nails, pins, latches, snap-fit fasteners, bayonet mounts, and other attachment means known in the art. Each possibility represents a separate embodiment. According to some embodiments, rear barrier 25 is configured to threadedly engage with protective cowling 24 utilizing a threaded configuration (embodiments not shown). According to some embodiments, protective cowling 24 comprises at least one protective cowling coupling bore 94*b* and rear barrier 25 comprises at least one rear barrier coupling portion 94*a*. According to further embodiments, at least one rear barrier coupling portion 94*a* is configured to be attached to at least one protective cowling coupling bore 94*b* via at least one of a rear barrier coupling means 94. According to still further embodiments, a plurality of protective cowling coupling bores 94*b* is configured to be attached to a corresponding plurality of rear barrier coupling portions 94*a*, by a corresponding plurality of rear barrier coupling means 94. According to some embodiments, rear barrier coupling means 94 are selected from screws, bolts, nails, pins, and other known coupling means known in the art. Each possibility represents a separate embodiment of the present invention.

According to some embodiments, protective cowling 24 is configured to be detachably attached to main body 12 utilizing screws. According to some embodiments, rear barrier 25 is configured to be detachably attached to protective cowling 24 utilizing screws.

According to some embodiments, there is provided a method for replacing propeller 22 attached to power unit 10 with an alternative propeller, wherein said alternative propeller is characterized by having a different blade configuration/shape but the same external dimensions as propeller 22, the method comprising the steps of:

a) detaching rear barrier 25 from protective cowling 24;
b) releasing propeller 22 from shaft 23;
c) attaching the alternative propeller to shaft 23; and
d) reattaching rear barrier 25 to protective cowling 24.

According to some embodiments, step (a) is performed by unfastening the screws connecting rear barrier 25 to protective cowling 24. According to some embodiments, step (d) is performed by refastening the screws connecting rear barrier 25 to protective cowling 24.

According to some embodiments, there is provided a method for replacing propeller 22 attached to underwater power unit 10 with an alternative propeller, wherein said alternative propeller is characterized by having different dimensions and optionally a different blade configuration/shape than those of propeller 22, utilizing an alternative cowling having different dimensions than those of protective cowling 24 (corresponding to the dimensions of the alternative propeller), the method comprising the steps of:

a) detaching rear barrier 25 from protective cowling 24;
b) releasing propeller 22 from shaft 23;
c) detaching protective cowling 24 from main body 12;
d) attaching an alternative cowling to main body 12;

e) attaching an alternative propeller to shaft 23, wherein the dimensions of said alternative propeller correspond to the dimension of the alternative cowling; and f) reattaching rear barrier 25 to the alternative cowling.

According to some embodiments, step (a) is performed by unfastening the screws connecting rear barrier 25 to protective cowling 24. According to some embodiments, step (c) is performed by unfastening the screws connecting protective cowling 24 to main body 12. According to some embodiments, step (d) is performed by fastening the screws connecting the alternative cowling to main body 12. According to some embodiments, step (f) is performed by refastening the screws connecting rear barrier 25 to the alternative cowling.

According to some embodiments, step (f) comprise attaching an alternative rear barrier to the alternative cowling, wherein the dimensions of the rear barrier correspond to the dimensions of the alternative cowling. According to further embodiments, step (f) comprise refastening the screws connecting the alternative rear barrier to the alternative cowling.

Advantageously, the present invention provides a simple method for rapidly exchanging propeller 22 with an alternative propeller 22, optionally having a different blade configuration/shape and/or dimensions, therefore affecting the underwater power unit 10 hydrodynamic characteristics and abilities. Moreover, by adjusting the different blade configuration/shape and/or dimensions of propeller 22, the underwater power unit 10 can be customized according to various users' demands.

Reference is now made to FIGS. 2B and 4D-4F. According to some embodiments, adaptor unit 18 is configured to enable detachable attachment of the underwater power unit 10 to the standard surfboard 2. According to some embodiments, adaptor unit 18 is configured to enable detachable attachment of the underwater power unit 10 to the user. According to some embodiments, adaptor unit 18 is configured to provide support to the user, during the operation of underwater power unit 10. Advantageously, according to some embodiments, the present invention provides a modular underwater power unit 10 which can be adapted to transform a standard surfboard 2 into a motorized surfboard 1 or can be utilized for diving and/or swimming applications.

According to some embodiments, adaptor unit 18 comprises adaptor coupling surface 18*b* configured to interact with, or to penetrate upper main body adaptor platform 28. According to some embodiments, coupling surface 18*b* is configured to be detachably attached to upper main body adaptor platform 28. The adaptor coupling surface 18*b* can be secured to upper main body adaptor platform 28 as described herein above.

According to some embodiments, adaptor unit 18 further comprise a board coupling portion, configured to be secured to the standard slot of the standard surfboard 2. According to further embodiments, said board coupling portion of adaptor unit 18 comprises various male type tabs configured to interact with a female type receiving slot of the standard surfboard 2.

According to some embodiments, the board coupling portion of adaptor unit 18 comprises FCS tabs 18*a*, configured to be secured to an FCS fin box of the standard surfboard 2, utilizing set screws. According to some embodiments, the board coupling portion of adaptor unit 18 comprises FCS II tabs 18*d*, configured to be secured to an FCS II fin box of the standard surfboard 2. According to some embodiments, the board coupling portion of adaptor unit 18 comprises futures single tab 18*e* or 18*c*, configured to be secured to a futures fin box of the standard surfboard 2. According to some embodiments, the board coupling portion of adaptor unit 18 comprises softboard tabs 18*f* including plugs, configured to be secured to a softboard fin box of the standard surfboard 2.

Advantageously, according to some embodiments, the present invention provides a plurality of adaptor units 18, each comprising a different board coupling portion configured to be secured to different types of fix boxes, without any need for structural modifications to said fix boxes, thereby enabling attachment of underwater power unit 10 to different types of fin boxes corresponding to various types of standard surfboards 2. While optional attachment of the underwater power unit 10 to a surfboard 2 via various optional types of adapter units 18 is described and illustrated, it will be clear that other types of adapter units 18 may be utilized to attach the underwater power unit 10 to other watercrafts, such as kayaks, canoes, paddle boards, life rafts, sail boards, inflatable watercrafts and the like.

According to some embodiments, adaptor unit 18 further comprise a user interaction portion, configured to be held by, or be secured to, the user, thereby connecting underwater power unit 10 directly to the user for various applications such as diving, swimming, and providing assistance during surfing. According to some embodiments, the user interaction portion of adaptor unit 18 comprises a double handle 18*g*, configured to be held by the user by both hands. According to some embodiments, the user interaction portion of adaptor unit 18 comprises a single handle 18*h*, configured to be held by the user by at least one hand. According to some embodiments, the user interaction portion of adaptor unit 18 comprises a double handle configuration comprising two single handles 18*h* (not shown), aligned in parallel or in line with each other, and configured to be held by the user by both hands.

According to some embodiments, the user interaction portion of adaptor unit 18 comprises an elastic strap 18*i*, configured to be secured directly to a limb or any portion of the body of the user. According to some embodiments, the elastic strap 18*i* is configured to be wrapped around the user's hand and/or wrist, as illustrated by FIG. 4F. According to some embodiments, the elastic strap 18*i* is configured to be wrapped around the user's chest, waist, or leg(s) (not shown). According to some embodiments, the elastic strap 18*i* comprises a foot strap 18*j*, which is configured to be wrapped around the user's ankle and/or foot, as illustrated by FIG. 4E.

Advantageously, according to some embodiments, the present invention provides a plurality of adaptor units 18, each comprising a different user interaction portion configured to be held by, or be secured to, the user, without any need for significant structural modifications to the underwater power unit 10, thereby utilize underwater power unit 10 for various applications such as diving, swimming, and providing assistance during surfing. For example, it is possible that a beginner user will require an adaptor unit 18 comprising a board coupling portion in order to attach underwater power unit 10 to standard surfboards 2, thus enabling excessive assistance during surfing, while an experienced user will require an adaptor unit 18 comprising a user interaction portion in order to attach underwater power unit 10 to the user's limb (e.g., a leg or a hand), thus enabling assistance during paddling that will not affect the hydrodynamic movement of the standard surfboards 2.

Reference is now made to FIGS. 2B, 4G and 5. According to some embodiments, lower fin attachment section 27 comprises a standard slot configured to interact with or be attached to, fin unit 16, as disclosed herein above. According to some embodiments, fin unit 16 comprises a standard fin. According to some embodiments, fin unit 16 is an FCS fin 16*a*. According to some embodiments, fin unit 16 is an FCS II fin 16*d*. According to some embodiments, fin unit 16 is a futures fin 16*c* or 16*e*. According to some embodiments, fin unit 16 is a longboard fin 16*f*. According to some embodiments, longboard fin 16*f* comprise winglets (finlets), as illustrated at FIG. 4G.

According to some embodiments, fin unit 16 extends perpendicularly downward from main body bottom surface 78 of main body 12 and is integrally formed therewith, as illustrated at FIG. 2B. According to further embodiments, fin unit 16 is a standard fin.

Reference is now made to FIG. 5. FIG. 5 illustrates various fin characteristics of a standard fin, according to some embodiments. Typically, standard fins have different dimensions and shapes. The standard fins can have different rakes as illustrated by rake arrow 68, different base lengths as illustrated by base length arrow 64, and different heights as illustrated by height arrow 66. The standard fins can be made from different materials affecting the rigidness or flexibility attributes of the fins. Typically, rigid fins are more stable and provide a solid platform for riding large waves, while soft and flexible fins are good for making fast or sharp turns but are more difficult to control compared to the rigid fins.

The terms "rake" and "sweep", as used herein, are interchangeable, and refer to backwards arc's degree of a front edge of the standard fin. Rake or sweep angle is a measurement that determines how far back the fin curves in relation to its base. The term "base length" as used herein, refers to base length of the standard fin in the widest point thereof, that is flush with the main body 12 once attached thereto. The term "height" as used herein, refers to the height or depth of the standard fin, and is typically measured from the base of the fin to the tallest/sharpest point of the fin (the tip).

According to some embodiments, the present invention provides a specialized flexible fin (not shown) configured to perform a repetitive movement, during the operation of underwater power unit 110, which is similar to the repetitive movement which fins of fish perform during swimming, thereby enhancing the hydrodynamic capabilities of underwater power unit 110 during operation. According to some embodiments, at least a portion of the specialized flexible fin is configured to perform the repetitive movement as presented herein, wherein said portion extends from the specialized flexible fin's base to the specialized flexible fin's tip. According to some embodiments, the specialized flexible fin is shaped similarly to a standard fin, such as but not limited to, an FCS fin, an FCS II fin, a futures fin, and other fins known in the art. Each possibility represents a separate embodiment. According to some embodiments, the specialized flexible fin comprises at least one elastic polymeric material.

The various fin characteristics as presented herein can affect the stability and control of the user over the surfboard during surfing, as well as the riding experience.

The underwater power unit 10, as disclosed herein, can be adapted to secure various standard fin types as described herein above, suitable for various users and uses, and therefore contribute to the cost effectiveness and/or manufacturing simplicity of underwater power unit 10. Moreover, previously disclosed motorized surfboards or motorized fins are manufactured integrally with a specific fin having predetermined dimensions and shapes. In order to change the fin, the user is required to change the entire motorized device (e.g., motorized fin or surfboard), resulting in a potentially highly expensive purchase of several motorized devices. Advantageously, the underwater power unit 10 as disclosed herein is modularly connectable to and compatible with various types of standard fins, such as but not limited to, FCS fins, FCS II fins, futures fins, softboard fins, other fins known in the art, or the specialized flexible fin as presented herein, so that the user is required to purchase only a single underwater power unit 10 which is compatible with various types of fins, thus providing a simple, versatile and economic solution for motorized surfing.

Figure 7:
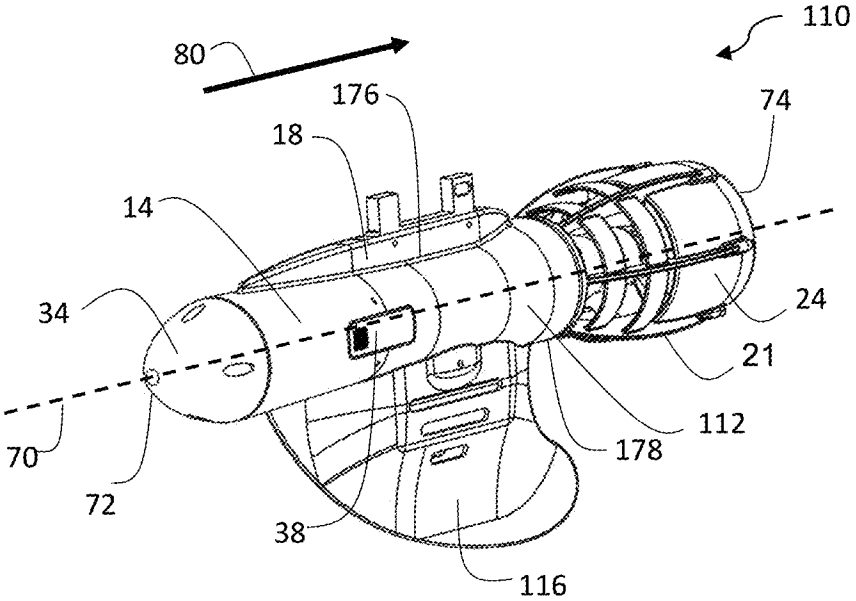
FIGS. 7-8 constitute a view in perspective and a side view, respectively, of underwater power unit 110, according to some embodiments.
Figure 8:
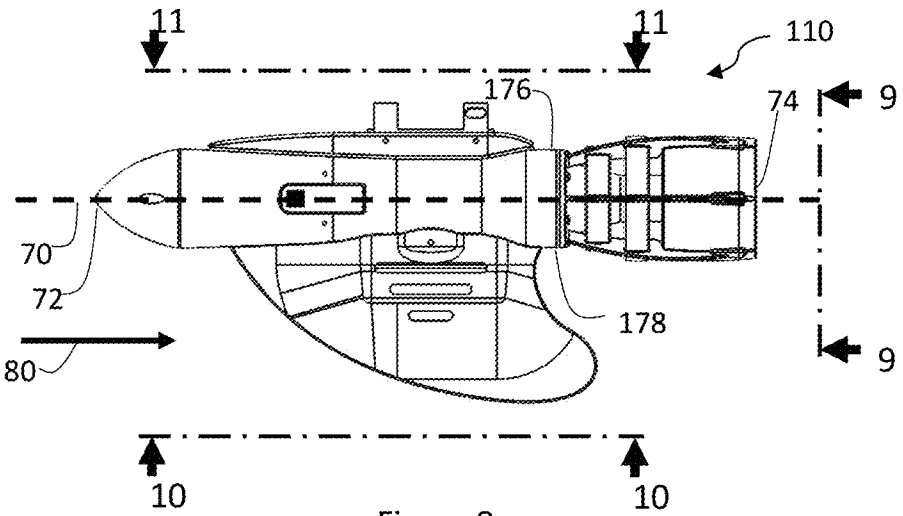
Figure 10:
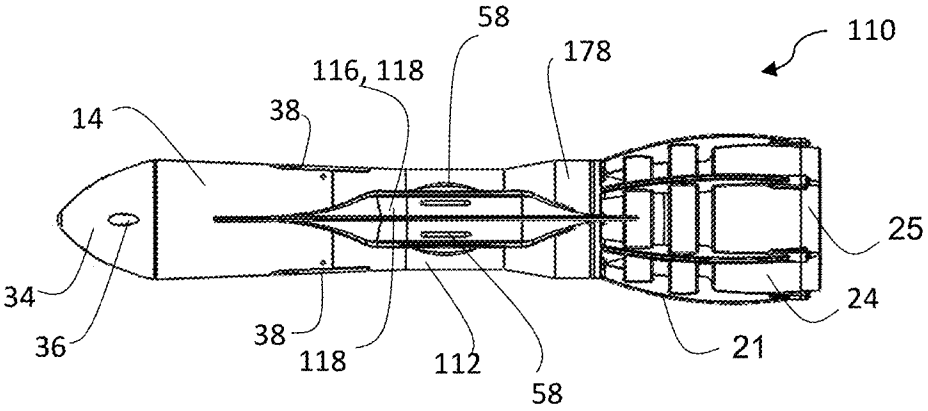
FIG. 10 constitutes a bottom-view of underwater power unit 110, taken on line 10-10 of FIG. 8.
Figure 11:
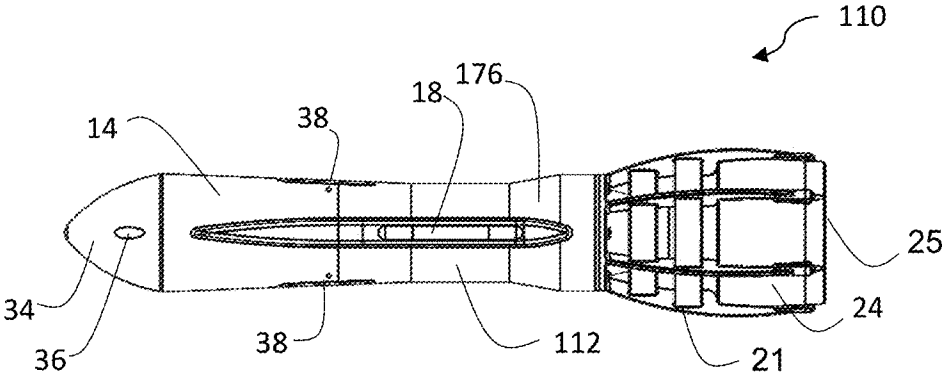
FIG. 11 constitutes a top-view of underwater power unit 110, taken on line 11-11 of FIG. 8.
Figure 9:
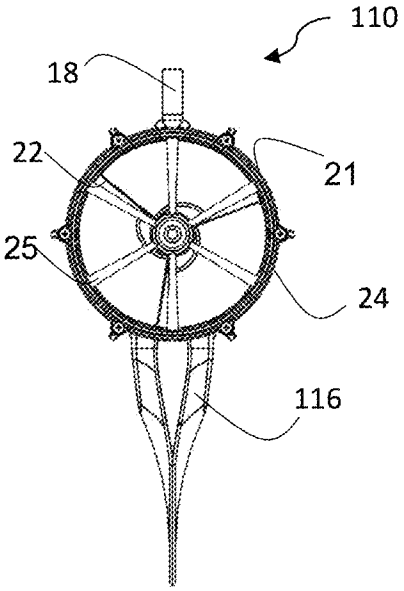
FIG. 9 constitutes a rear-view of underwater power unit 110, taken on line 9-9 of FIG. 8.
Figure 12:
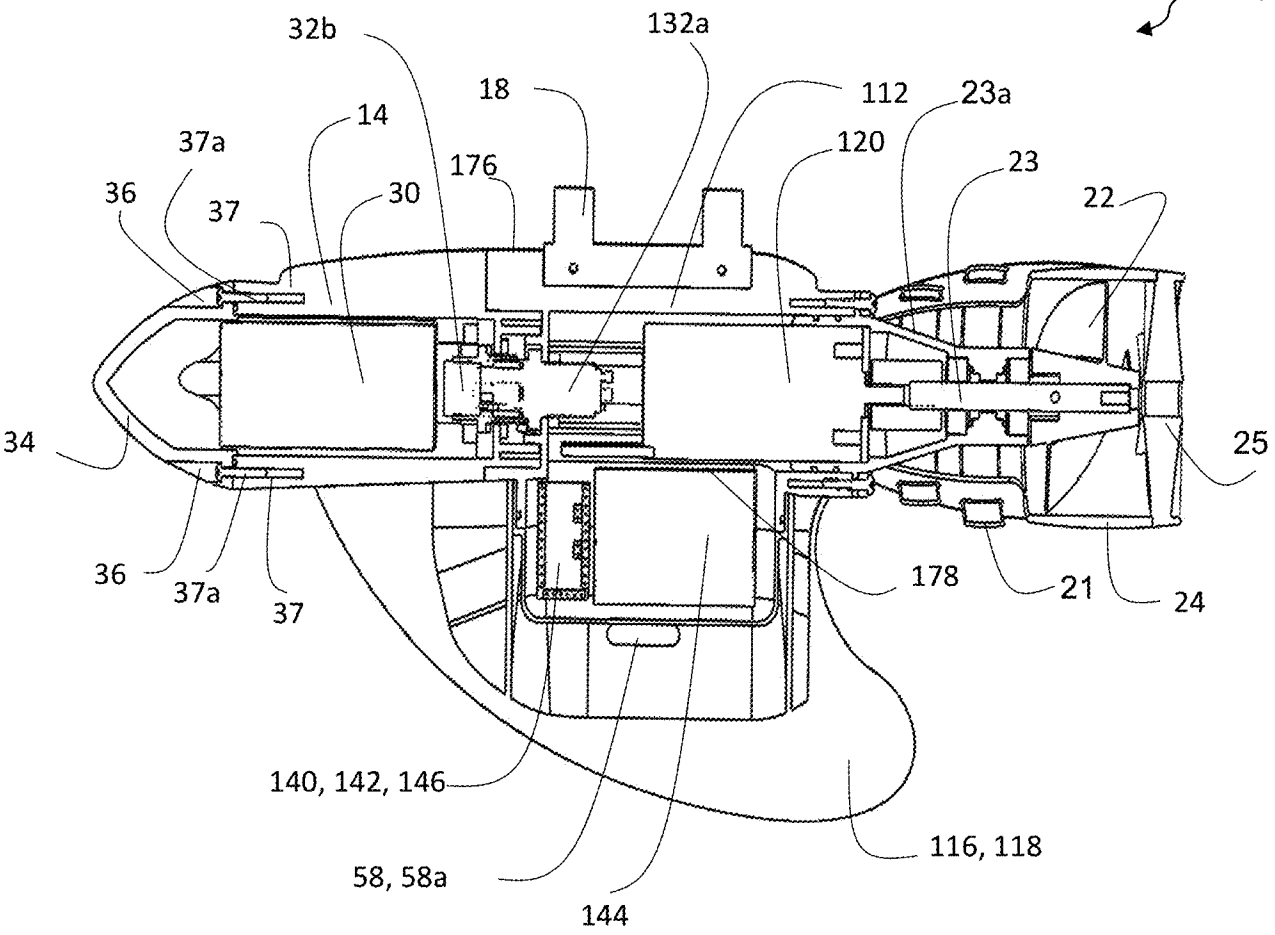
FIG. 12 constitutes a cross-sectional view of underwater power unit 110, according to some embodiments.
Figure 13:
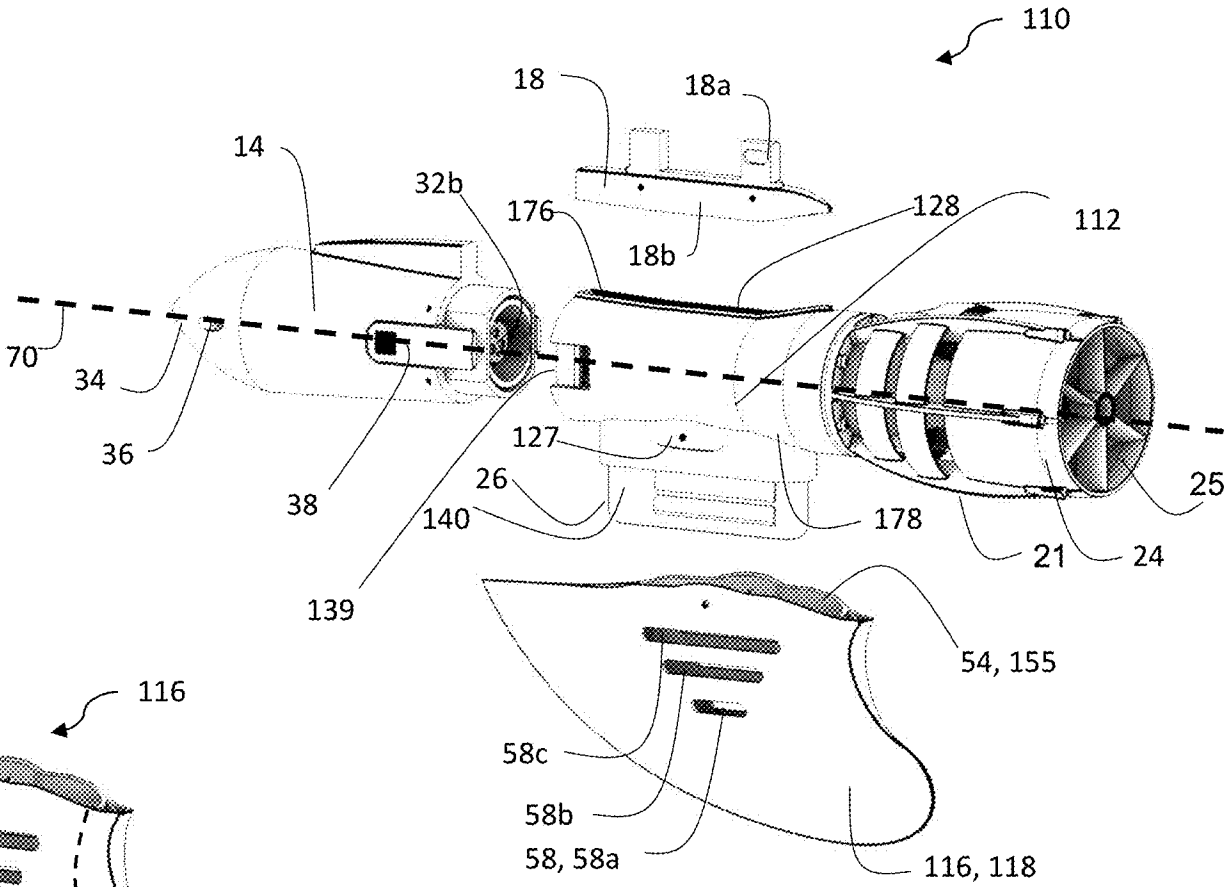
FIG. 13 constitutes an exploded view in perspective of underwater power unit 110, according to some embodiments.
Figure 14:
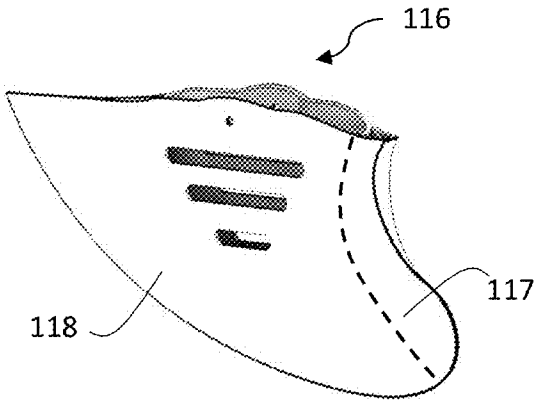
FIG. 14 constitutes a view in perspective of fin unit 116, according to some embodiments.

Reference is now made to FIGS. 7-14. FIGS. 7-8 constitute a view in perspective and a side view, respectively, of underwater power unit 110, according to some embodiments. FIG. 9 constitutes a rear-view of the underwater power unit 110, taken on line 9-9 of FIG. 8. FIG. 10 constitutes a bottom-view of underwater power unit 110, taken on line 10-10 of FIG. 8. FIG. 11 constitutes a top-view of underwater power unit 110, taken on line 11-11 of FIG. 8. FIG. 12 constitutes a cross-sectional view of underwater power unit 110, according to some embodiments. FIG. 13 constitutes an exploded view in perspective of underwater power unit 110, according to some embodiments. FIG. 14 constitutes a view in perspective of fin unit 116, according to some embodiments.

According to some embodiments, there is provided an underwater power unit 110. According to some embodiments, underwater power unit 110 is similar to underwater power unit 10 as described and illustrated herein above, except that the control unit 140 of underwater power unit 110 is located in a respective position radially offset from the central longitudinal axis 70, and main body 112 further comprises a control unit housing 26 located in a respective position radially offset from the central longitudinal axis 70 and extending perpendicularly downward from main body bottom surface 178, wherein the control unit 140 is disposed within control unit housing 26, as illustrated at FIGS. 12 and 13. According to some embodiments, control unit housing 26 is integrally formed with main body 112.

According to some embodiments, underwater power unit 110 comprises: power source housing 14 comprising at least one power source 30 disposed within as presented herein above. According to further embodiments, underwater power unit 110 further comprises: a main body 112 comprising: an upper main body adaptor platform 128 configured to be detachably attached to the adaptor unit 18 as presented herein above; a lower fin attachment section 127 configured to be detachably attached to a fin unit 116; the control unit 140 disposed within control unit housing 26; and a motor 120 disposed within main body 112, wherein said motor 120 is configured to be coupled to propeller 22 via shaft 23 as presented herein above. According to further embodiments, underwater power unit 110 further comprises: rear unit 21 at least partially encompassing said propeller 22 and a portion of said shaft 23, as presented herein above. According to some embodiments, control unit 140 comprises at least one of processor 142, communication module 146 and electronic speed control unit 144.

According to some embodiments, processor 142, communication module 146 and electronic speed control unit 144 are located at radially offset positions from at least one of the central longitudinal axis 70 and/or motor 120, as illustrated at FIGS. 12 and 13. According to some embodiments, control unit 140 of underwater power unit 110 comprising processor 142, communication module 146 and electronic speed control unit 144 is similar to control unit 40 of underwater power unit 10 comprising processor 42, communication module 46 and electronic speed control unit 44, respectively. According to some embodiments, motor 120 and second power connector 132*a* of underwater power unit 110 are similar to motor 20 and second power connector 32*a* of underwater power unit 10, respectively.

According to some embodiments, processor 142, communication module 146 and electronic speed control unit 144 are disposed within control unit housing 26. According to some embodiments, control unit 140 is in direct contact with control unit housing 26. According to some embodiments, processor 142, communication module 146 and electronic speed control unit 144 are in direct contact with control unit housing 26.

According to some embodiments, control unit 140 is not aligned with the electric components disposed within main body 112 along the central longitudinal axis 70. Since the control unit 40 can be located radially offset from the central longitudinal axis 70 within control unit housing 26, and is not aligned with the electric components disposed within main body 112, the length of main body 112 along the central longitudinal axis 70 can be shortened compared to the length of main body 12. Advantageously, shortening the length of main body 112 along the central longitudinal axis 70 can improve the hydrodynamic behavior of underwater power unit 110, thus providing the user with increased control and stability over the surfboard. It is contemplated that by shortening the length of main body 112, the hydrodynamic friction between the surrounding water and underwater power unit 110 during the operation thereof will lessen, thereby improving the hydrodynamic performances of underwater power unit 110, such as for example, improving the performances of motor 120 resulting in a slower discharge rate of power source 30.

Additionally, it is contemplated that by shortening the length of main body 112 relative to the length of main body 12, the center of mass (i.e., balance point) of underwater power unit 110 located along central longitudinal axis 70 can shift closer in parallel to the center of upper main body adaptor platform 128. Since body adaptor platform 128 is configured to enable the attachment of underwater power unit 110 to the standard surfboard 2 via the adaptor unit 18, shifting the balance point of underwater power unit 110 closer to the center of upper main body adaptor platform 128 enables forming a shorter pathway between the standard surfboard 2 and the balance point of underwater power unit 110. Such a shorter pathway enables a stronger connection between the standard surfboard 2 and underwater power unit 110 during the operation thereof, and reduces the risk of disengagement/separation therebetween. It is further contemplated that as the balance point of underwater power unit 110 is further distanced from the attachment point to standard surfboard 2 (via adaptor unit 18), a higher force is applied on said attachment point during the operation thereof, which can result in the disengagement of underwater power unit 110 therefrom. Advantageously, shortening the length of main body 112 along the central longitudinal axis 70 as disclosed herein can enable a stronger attachment between the standard surfboard 2 and underwater power unit 110.

Reference is now made to FIGS. 10 and 13-14. According to some embodiments, fin unit 116 comprises at least two walls, wherein each wall exhibits an outer surface 118 and an inner surface 54 opposing the outer surface 118, wherein the inner surfaces 54 of the at least two walls define a hollow fin space 155 therebetween. According to some embodiments, the inner surfaces 54 are configured to interact with or to encompass control unit housing 26. According to some embodiments, control unit housing 26 is shaped to fit into the hollow fin space 155. According to some embodiments, when fin unit 116 is attached to main body 112, the inner surfaces 54 encompasses control unit housing 26. According to some embodiments, the hollow fin space 155 enables the inner surfaces 54 to encompasses and optionally contact the control unit housing 26 of main body 112, when attached thereto. According to some embodiments, the base of fin unit 116 is configured to be in line with main body 112, when attached thereto.

According to some embodiments, main body 112 comprises lower fin attachment section 127 located at an external surface of control unit housing 26 and configured to detachably attach fin unit 116 to main body 112. According to some embodiments, fin unit 116 is configured to be secured or attached to lower fin attachment section 127 utilizing attachment means such as bolts, screws, set screws, nails, pins, latches, snap-fit fasteners, bayonet mounts, and other attachment means known in the art. Each possibility represents a separate embodiment. According to some embodiments, lower fin attachment section 127 comprises at least one threaded bore, or preferably at least two threaded bores. During the attachment of fin unit 116 to main body 112, at least one threaded screw can be used to secure fin unit 116 to lower fin attachment section 127.

According to some embodiments, fin unit 116 is configured to provide underwater power unit 10 with improved hydrodynamic behavior, similar to that provided by the standard fin. According to some embodiments, the present invention provides a plurality of fin units 116, wherein each one is characterized by having different external dimensions and shapes. According to some embodiments, the plurality of fin units 116 is manufactured to have different rakes, different base lengths, and different heights. According to some embodiments, the plurality of fin units 116 comprises various materials, affecting the rigidness or flexibility attributes of each fin unit 116.

According to some embodiments, fin unit 116 comprise a rear flexible portion 117, as illustrated at FIG. 14. According to some embodiments, the rear flexible portion 117 of fin unit 116 is configured to perform a repetitive movement, during the operation of underwater power unit 110, which is similar to the repetitive movement which fins of fish perform during swimming, thereby enhancing the hydrodynamic capabilities of underwater power unit 110 during operation.

The variety of fin units 116 as presented herein can be suitable to a variety of users having different weights, a variety of wave types (such as small and large waves) or a variety of standard surfboards 2 (such as shortboard or longboard). previously disclosed motorized surfboards or motorized fins in the art are manufactured integrally with a specific fin having predetermined external dimensions and shape. In order to change the fin, the user is required to change the entire motorized device (e.g., motorized fin or surfboard), resulting in an optional highly expensive purchase of several motorized devices. Advantageously, the underwater power unit 10 as disclosed herein is modularly connectable to and compatible with various types of fin units 116, so that the user is required to purchase a single underwater power unit 110 with optionally several types of fin units 116. Since the effective cost of a plurality of fin units 116 is significantly lower than the cost of a complete underwater power unit 110, due to lack of moving electric components, the present invention provides a simple, versatile and economic solution for motorized surfing.

According to some embodiments, the control unit 140 generates excessive heat during the operation of underwater power unit 110. In order to prevent control unit 140 from overheating, heat or thermal energy needs to be transferred from control unit housing 26 to the surrounding environment of underwater power unit 110. The surrounding environment of underwater power unit 110 can be air, or preferably water. According to some embodiments, control unit housing 26 comprises at least one thermally conductive material, selected from a metal, a metal alloy, a conductive polymer, and combinations thereof. According to some embodiments, at least a portion of an external surface of the control unit housing 26 comprises the at least one thermally conductive material. The metal can be aluminum.

According to some embodiments, fin unit 116 further comprises at least one heat expel element 58. According to some embodiments, fin unit 116 comprises at least two heat expel elements 58, wherein each one is located on each one of the outer surfaces 118 of fin unit 116, as illustrated at FIG. 10. According to some embodiments, fin unit 116 comprises a plurality of heat expel elements 58, as illustrated at FIG. 13.

According to some embodiments, at least one heat expel element 58 is a heat expel opening comprising at least one opening extending through at least one wall of the fin unit 116, such as through the inner surface 54 towards the outer surface 118. According to some embodiments, heat expel opening is configured to allow direct contact between control unit housing 26 and the surrounding environment. By allowing direct contact between control unit housing 26 and the surrounding environment to occur, heat can transfer from control unit housing 26 to the water surrounding it, resulting in the cooling of control unit housing 26 and the electric components disposed within. According to some embodiments, the heat expel opening is in the shape of an elongated opening. According to some embodiments, heat expel opening comprises a plurality of openings.

According to some embodiments, at least one heat expel element 58 comprise a heat expel conducting surface. According to some embodiments, the heat expel conducting surface comprises a highly conductive thermal material. The highly conductive thermal material can comprise a metal, metal alloy, a conductive polymer, and combinations thereof. According to some embodiments, the heat expel conducting surface is in direct contact with control unit housing 26. By allowing direct contact between control unit housing 26 and the heat expel conducting surface, heat can transfer from control unit housing 26 to the water surrounding it through the heat expel conducting surface, resulting in the cooling of control unit housing 26 and the electric components disposed within.

According to some embodiments, the heat expel conducting surface is flush with the outer surface 118 of fin unit 16, as illustrated at FIG. 13. According to some embodiments, the heat expel conducting surface is extending away from the outer surface 118 of fin unit 16 (not shown). The heat expel conducting surface can extend away from the outer surface 118 of fin unit 16 in order to increase the surface area of the heat expel conducting surface, and therefore to enhance the heat transfer from control unit housing 26 to the surrounding environment. According to some embodiments, the heat expel conducting surface comprises a plurality of heat expel conducting surfaces, wherein each one is extending away from the outer surface 118 of fin unit 16. According to further embodiments, the plurality of heat expel conducting surfaces is a heat sink.

The term "heat sink" as used herein, refers to a passive heat exchanger that transfers thermal energy generated within control unit housing 26 to an external environment (typically the water surrounding the passive heat exchanger) where it is dissipated away from the passive heat exchanger, thereby allowing the electric components disposed within control unit housing 26 to cool. The heat sink is typically made from a highly conductive thermal material, and is designed to maximize the its surface area in contact with the external environment surrounding it. According to some embodiments, at least one heat expel element 58 comprises at least one heat sink, configured to transfer thermal energy from control unit housing 26 to the surrounding environment, thereby to cool control unit 40.

According to some embodiments, the at least one heat expel element 58 comprises a heat expel opening 58*a*, a first heat expel conducting surface 58*b* and a second heat expel conducting surface 58*c*, located at each one of at least two outer surfaces 118 of fin unit 116, as illustrated at FIG. 13. According to some embodiments, during the attachment of fin unit 116 to main body 112, the first heat expel conducting surface 58*b* and the second heat expel conducting surface 58*c* are in direct contact with the thermally conductive portions of the external surface of the control unit housing 26, thereby allowing heat transfer directly therethrough to the surrounding environment and cooling control unit housing 26. According to further embodiments, heat expel opening 58*a* comprises a heat transferring tube extending through both outer surfaces 118 and in contact with the bottom edge of the control unit housing 26. According to still further embodiments, the heat transferring tube is configured to allow the access of water therein, enabling heat transfer from the bottom end of control unit housing 26 to the water passing therethrough, and discharge heated water to the surrounding environment, thereby cooling not only the sidewalls of the control unit housing 26 via heat expel conducting surfaces such as the first heat expel conducting surface 58*b* and the second heat expel conducting surface 58*c*, but rather also from the bottom end of the control unit housing 26. According to yet still further embodiments, the heat transferring tube is a tubular member having a circular, oval or elliptic cross-section. According to still further embodiments, the heat transferring tube comprises a thermal conducting material, as presented herein above.

According to some embodiments, as described herein above, underwater power unit 110 provides a specific configuration of underwater power unit 10, wherein the control unit 140 is located radially offset from the central longitudinal axis 70, and is disposed within the control unit housing 26. Therefore, control unit housing 26 can come into direct contact with the at least one heat expel element 58 disposed on each one of the two outer surfaces 118 of fin unit 116, thereby directly or indirectly releasing the heat generated within control unit housing 26 into the surrounding environment therethrough. Advantageously, this configuration allows enhanced heat expel capabilities and prevents from the control unit 140 to overheat, resulting in improved performance of underwater power unit 110 during operation.

Reference is now made to FIG. 12. According to some embodiments, nose cap 34 is detachably attached to power source housing 14. According to some embodiments, nose cap 34 comprises at least one coupling opening 36 configured to receive at least one coupling means 37*a*, wherein the at least one coupling means 37*a* is configured to enter or engage with at least one the coupling openings 36. According to some embodiments, power source housing 14 comprise at least one coupling bore 37 configured to receive and engage with the at least one coupling means 37*a*. According to some embodiments, at least one coupling means 37*a* is configured to detachably attach at least one coupling opening 36 of nose cap 34 to at least one coupling bore 37 of power source housing 14, thereby to detachably attach nose cap 34 to power source housing 14.

According to some embodiments, nose cap 34 comprise at least two coupling openings 36 configured to receive at least two coupling means 37*a*, wherein each one of coupling means 37*a* is configured to enter or engage with each one of the coupling openings 36. According to some embodiments, power source housing 14 comprise at least two coupling bores 37, wherein each one is configured to receive and engage with each one of the at least two coupling means 37*a*. According to some embodiments, at least two coupling means 37*a* are configured to detachably attach at least two coupling openings 36 of nose cap 34 to at least two coupling bores 37 of power source housing 14, thereby to detachably attach nose cap 34 to power source housing 14, as illustrated at FIG. 12.

According to some embodiments, coupling means 37*a* are selected from screws, bolts, nails, pins, and other connecting means known in the art. Each possibility represents a separate embodiment of the present invention. According to some embodiments, nose cap 34 comprise a plurality of coupling openings 36 configured to be detachably attached to a corresponding plurality of coupling bores 37 of power source housing 14, by a corresponding plurality of coupling means 37*a*.

Advantageously, at least one power source 30 can be easily inserted into and/or removed from power source housing 14 by the detachment of nose cap 34 therefrom as was presented herein above, without any structural modifications to power source housing 14. According to some embodiments, the attachment of nose cap 34 to power source housing 14 is waterproof sealed, thereby preventing water from entering into the interior of power source housing 14.

According to some embodiments, the present invention provides a power source housing kit comprising a plurality of power source housings 14 configured to be detachably attached to main body 12 or main body 112, wherein each power source housing 14 comprises at least one power source 30 disposed within, wherein each at least one power source 30 is a rechargeable battery having a different voltage output, as presented herein above.

According to some embodiments, the present invention provides a propeller kit comprising a plurality of propellers 22 configured to be detachably attached to shaft 23, wherein each one comprises a different blade shape and/or dimensions, as presented herein above.

According to some embodiments, the present invention provides a rear unit kit comprising a plurality of protective cowlings 24 configured to be detachably attached to main body 12 or main body 112, and a corresponding plurality of rear barriers 25, each one is characterized by having different dimensions, wherein the dimensions of each one of the plurality of protective cowlings 24 and corresponding plurality of rear barriers 25 correspond to the dimensions of each one of the plurality of propellers 22, as presented herein above.

According to some embodiments, the present invention provides an adaptor unit kit comprising a plurality of adaptor units 18 configured be detachably attached to upper main body adaptor platform 28 or upper main body adaptor platform 128, each comprising a different board coupling portion configured to be secured to different types of fix boxes or a different user interaction portion configured to be held by, or be secured to, the user, as presented herein above.

According to some embodiments, the present invention provides a fin unit kit comprising a plurality of fin units 116 configured be detachably attached to lower fin attachment section 127, wherein each fin unit 116 is characterized by having different external dimensions and shapes, and optionally wherein each fin unit 116 comprises at least one heat expel element 58, as presented herein above. According to some embodiments, the fin unit kit comprises at least one standard fin (such as FCS fins, FCS II fins, futures fins, or other standard fins known in the art) or the specialized flexible fin as presented herein.

According to some embodiments, the present invention provides a kit comprising: at least one underwater power unit 10; at least one of: the power source housing kit, the propeller kit, the rear unit kit, the adaptor unit kit, the fin unit kit, and combinations thereof; and optionally the designated device, as presented herein above. According to some embodiments, the present invention provides a kit comprising: at least one underwater power unit 110; at least one of: the power source housing kit, the propeller kit, the rear unit kit, the adaptor unit kit, the fin unit kit, and combinations thereof; and optionally the designated device, as presented herein above.

Figure 15:
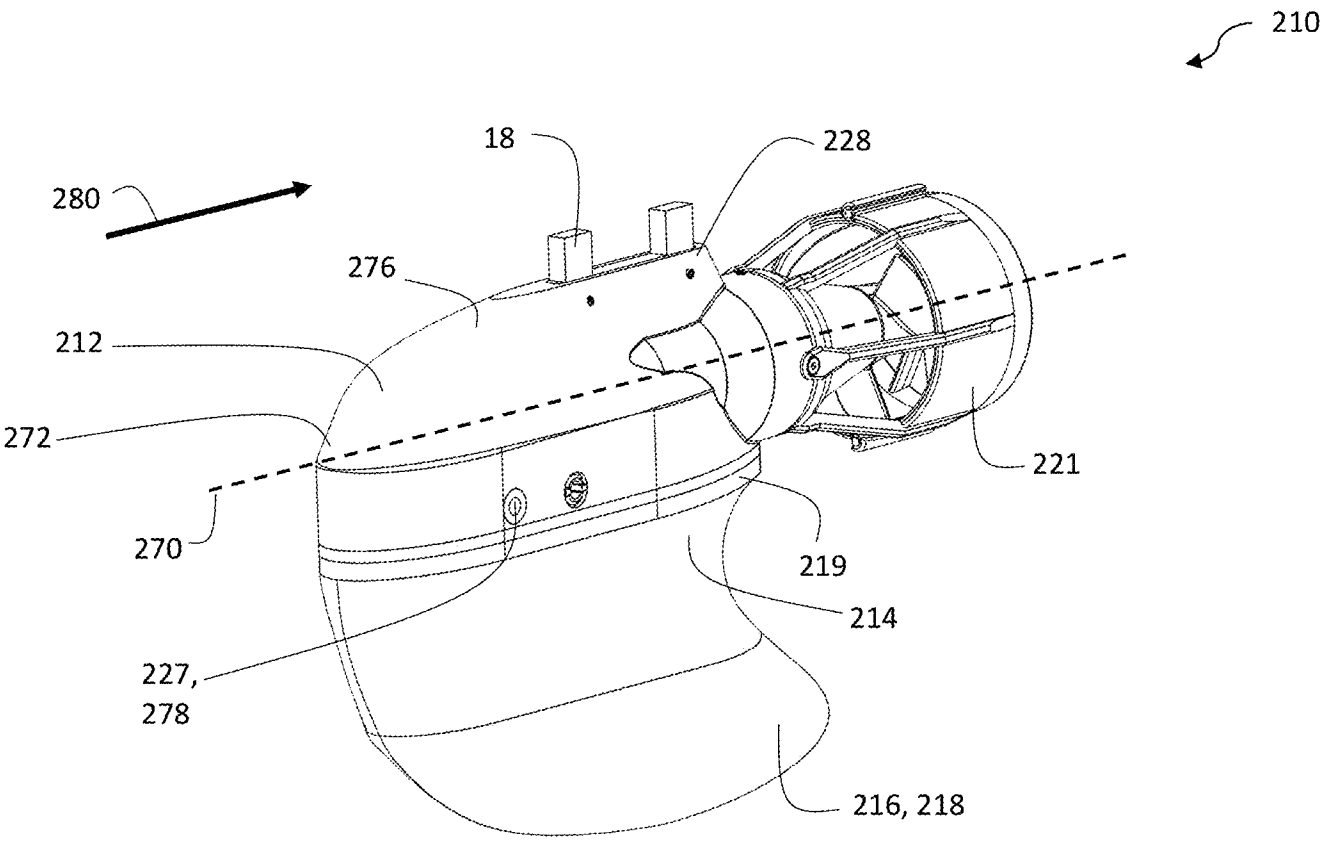
FIG. 15 constitute a view in perspective of underwater power unit 210, according to some embodiments.
Figure 16:
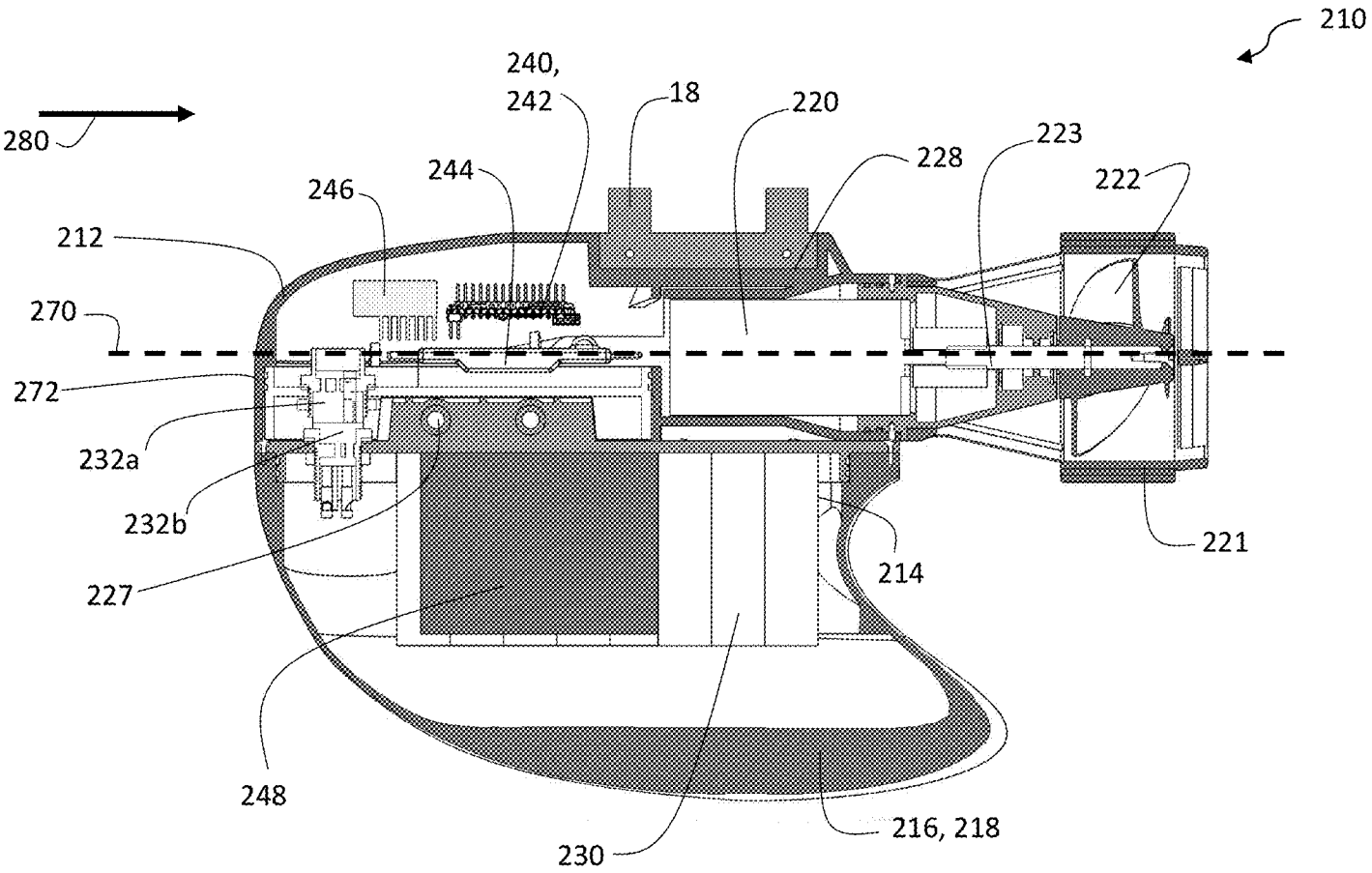
FIG. 16 constitute a cross-sectional view of underwater power unit 210, according to some embodiments.
Figure 17:
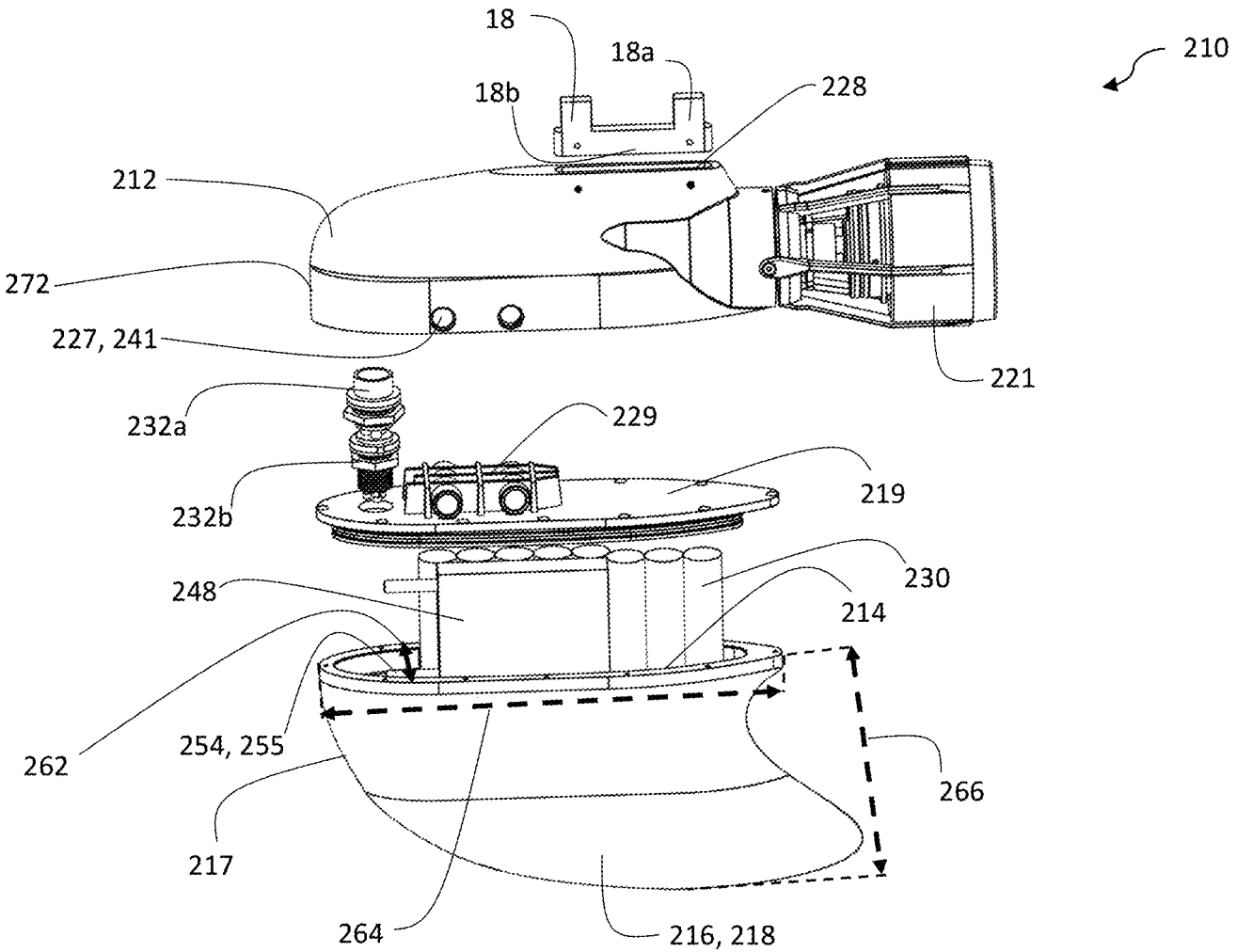
FIG. 17 constitutes an exploded view in perspective of underwater power unit 210, according to some embodiments.

Reference is now made to FIGS. 15-17. FIG. 15 constitute a view in perspective of underwater power unit 210, according to some embodiments. FIG. 16 constitute a cross-sectional view of underwater power unit 210, according to some embodiments. FIG. 17 constitutes an exploded view in perspective of underwater power unit 210, according to some embodiments.

According to some embodiments, there is provided an underwater power unit 210. According to some embodiments, underwater power unit 210 is similar to underwater power unit 110, as described and illustrated herein above, except that underwater power unit 210 comprises a fin unit 216 comprising a power source housing 214 disposed therein.

According to some embodiments, underwater power unit 210 comprises a main body 212. According to further embodiments, main body 212 comprises an upper main body adaptor platform 228 located at a main body top surface 276 and configured to be detachably attached to the adaptor unit 18, as disclosed herein above. According to further embodiments, main body 212 further comprises a lower fin attachment section 227 located at a main body bottom surface 278 and configured to be detachably attached to a fin unit 216. According to further embodiments, main body 212 further comprises a control unit 240 and a motor 220 disposed therein, wherein said motor 220 is configured to be coupled to a propeller 222 via a shaft 223. According to some embodiments, at least one of upper main body adaptor platform 228 and fin attachment section 227 is substantially parallel to a central longitudinal axis 270 extending through main body 212.

It is to be understood that motor 220 of underwater power unit 210 can be identical to motor 120 of underwater power unit 110 and/or motor 20 of unit 10, as disclosed herein above.

According to some embodiments, underwater power unit 210 further comprises a rear unit 221 encompassing said propeller 222 and a portion of said shaft 223. According to some embodiments, shaft 223 extends from motor 220 in the distal direction 280, as illustrated at FIG. 15. According to some embodiments, motor 220 is configured to be electronically coupled to at least one power source 230. According to some embodiments, rear unit 221 is detachably attached to main body 212. It is to be understood that rear unit 221, propeller 222, and shaft 223 of underwater power unit 210 can be identical to rear unit 21, propeller 22, and shaft 23, respectively, of underwater power units 110 and/or 10, as disclosed herein above.

According to some embodiments, upper main body adaptor platform 228 is configured to interact with, or to receive an adaptor coupling surface 18*b* of the adaptor unit 18, as illustrated at FIG. 17. It is to be understood that upper main body adaptor platform 228 of underwater power unit 210 can be identical to upper main body adaptor platform 128 of underwater power unit 110, as disclosed herein above.

According to some embodiments, the control unit 240 comprises at least one of a processor 242, a communication module 246, and an electronic speed control unit 244 (i.e., ESC 244). According to some embodiments, each one of processor 242, electronic speed control unit 244, and communication module 246 is mounted on the same PCB. According to some embodiments, communication module 246 is embedded within processor 242. According to some embodiments, processor 242, electronic speed control unit 244, and communication module 246 are separate components which are in electrical and/or functional communication with each other.

According to some embodiments, processor 242, communication module 246 and electronic speed control unit 244 are substantially aligned with motor 220 within main body 212, along the central longitudinal axis 270. According to some embodiments, central longitudinal axis 270 extends through at least a portion of control unit 240 and at least a portion of motor 220. According to some embodiments, central longitudinal axis 270 extends through at least a portion of processor 242, at least a portion of electronic speed control unit 244, at least a portion of communication module 246, and at least a portion of motor 220. According to some embodiments, each one of processor 242, communication module 246 and electronic speed control unit 244 are located in parallel to the central longitudinal axis 270, within main body 212.

It is to be understood that control unit 240 of underwater power unit 210 comprising processor 242, communication module 246 and electronic speed control unit 244, have the same functionality and/or is identical to control unit 140 of underwater power unit 110 comprising processor 142, communication module 146 and electronic speed control unit 144, as disclosed herein above.

According to some embodiments, the underwater power unit 210 comprises a fin unit 216 comprising the power source housing 214 disposed therein. According to further embodiments, the power source housing 214 is not aligned with main body 212 along the central longitudinal axis 270, when the fin unit 216 is attached to the main body 212. According to still further embodiments, the power source housing 214 and the main body 212 does not intersect the central longitudinal axis 270.

According to some embodiments, main body 212 extends from an underwater power unit front end 272 towards the rear unit 221. Since the power source housing 214 is disposed within the fin unit 216, and is not located externally to the main body 212 along the central longitudinal axis 270, the entire length of the underwater power unit 210 along the central longitudinal axis 270 can be reduced, relative to the length of units 110 or 10, as disclosed herein above. Advantageously, shortening the length of underwater power unit 210, by inserting the power source housing 214 within the fin unit 216, can improve the hydrodynamic behavior thereof, thus providing the user with increased control and stability over the surfboard, such as during fast or sharp turns over waves while surfing. It is contemplated that by shortening the length of unit 210, the hydrodynamic friction between the surrounding water and unit 210 during the operation thereof will lessen, thereby improving the hydrodynamic performances of underwater power unit 210.

Moreover, in some embodiments, the underwater power unit front end 272 of main body 212 and a front end 217 of the outer surfaces 218 of the walls of the fin unit 216 are aligned with each other, vertically to the central longitudinal axis 270. In further such embodiments, when main body 212 and fin unit 216 are attached, their front ends are flush and form a continuous outer surface, which causes the underwater power unit 210 to have a front end shaped as a fin (e.g., fin of a fish or a standard fin). In further such embodiments, in this flush alignment, there are no portions of unit 210 located externally to the main body 212 along the central longitudinal axis 270. Advantageously, this form of flush alignment can improve the hydrodynamic behavior of underwater power unit 210 by reducing the hydrodynamic friction between the surrounding water and unit 210 during the operation thereof, thereby improving the hydrodynamic performances of underwater power unit 210 and providing the user with increased control and stability over the surfboard. Furthermore, improving the hydrodynamic behavior of underwater power unit 210 may also improve and/or maximize the life and lifespan of the power source 230 (i.e., battery life).

According to some embodiments, fin unit 216 comprises at least two walls, wherein each wall exhibits an outer surface 218 and an inner surface 254 opposing the outer surface 218, wherein the inner surfaces 254 of the at least two walls define a hollow fin space 255 therebetween. In further embodiments, fin unit 216 further comprises a fin unit cover 219 configured to be detachably attached to the fin unit walls. In some embodiments, the at least two fin unit walls, and optionally the fin unit cover 219, define the hollow fin space 255 therebetween. In some embodiments, the power source housing 214 is disposed within the hollow fin space 255. In further embodiments, the power source housing 214 is in direct contact with the inner fin surfaces 254. In further embodiments, fin unit cover 219 comprises a cover protrusion 229 extending away therefrom in the direction of the main body 212.

According to some embodiments, fin unit 216 is configured to be detachably attached to the main body 212. In further embodiments, fin unit 216 is configured to be detachably attached to the lower fin attachment section 227 located at a main body bottom surface 278 of main body 212. In still further embodiments, fin unit cover 219 is configured to be secured or attached to the lower fin attachment section 227 utilizing attachment means such as bolts, screws, set screws, nails, pins, latches, snap-fit fasteners, bayonet mounts, and other attachment means known in the art. Each possibility represents a separate embodiment.

According to some embodiments, lower fin attachment section 227 comprises at least one threaded bore 241, or preferably at least two threaded bores 241. According to further such embodiments, during the attachment of fin unit 216 to main body 212, at least two threaded screws can be used to secure the cover protrusion 229 of fin unit cover 219 to the at least two threaded bores 241 of lower fin attachment section 227.

According to some embodiments, fin unit 216 comprises a first power connector 232*b* disposed therein, configured to be electronically coupled to a second power connector 232*a*, wherein the second power connector 232*a* is disposed within the main body 212. According to some embodiments, first power connector 232*b* is configured to transfer electric power from at least one power source 230 to the second power connector 232*a*, during the attachment of fin unit 216 to main body 212. According to further embodiments, to second power connector 232*a* is configured to transfer said electric power, directly or indirectly, to motor 220. According to some embodiments, first power connector 232*b* and second power connector 232*a* are waterproof. The first power connector 232*b* can be a male type connector while the second power connector 232*a* can be a female type connector, or vice versa. The first and second power connectors 232*b* and 232*a* can be identical to the first and second power connectors 32*b* and 32*a*, as presented herein above.

According to some embodiments, power source housing 214 comprises at least one power source 230 disposed within, configured to be electronically connected, directly or indirectly, to motor 220 and to provide electric power thereto. According to some embodiments, at least one power source 230 is rechargeable. According to some embodiments, at least one power source 230 is a battery, such as for example, a lithium-ion polymer (Li-ion polymer) battery.

According to some embodiments, the power source housing 214 comprises a plurality of power sources 230 disposed therein, as can be seen for example, in FIGS. 16 and 17. In further such embodiments, the plurality of power sources 230 are aligned in a row. In further embodiments, the plurality of power sources 230 are aligned in parallel to each other, vertically to the central longitudinal axis 270. The plurality of power sources can be a plurality of batteries.

According to some embodiments, the power source housing 214 is in a form of a battery holder, a battery socket, a battery connector, or a combination thereof, which comprises the plurality of power sources 230 disposed therein.

According to some embodiments, fin unit 216 comprises a power source controller 248 disposed therein, wherein said controller 248 is configured to transfer and/or regulate/balance electric power from the plurality of power sources 230 to the motor 220. The controller 248 and/or the power source housing 214 comprising the plurality of power sources 230 can be in direct contact with the inner surfaces 254 of fin unit 216. Furthermore, the plurality of power sources 230 can be in direct contact with the inner surfaces 254 of fin unit 216. According to some embodiments, at least one of the controller 248, the power source housing 214, and the plurality of power sources 230 are in direct contact with the inner surfaces 254 of the fin unit 216. According to further such embodiments, the controller 248, the power source housing 214, and the plurality of power sources 230 are in direct contact with the inner surfaces 254 of the fin unit 216.

According to some embodiments, the power source controller 248 comprise a battery management system (BMS) which is configured to protect the plurality of power sources 230 during charging and discharging thereof. During charging, the BMS can monitor the voltage of each one of the plurality of power sources 230 and balance electric distribution therebetween, to ensure the equal power charge thereof. During discharging, the BMS can monitor the voltage of the plurality of power sources 230 and the discharge current thereof. If the BMS determines that any of its limits have been passed, such as the plurality of power sources 230 draining too low, the BMS can deactivate each of the power sources 230, for the protection thereof. The power source controller 248 can be, for example, a Li-ion 4S 12V BMS.

The power source controller 248 can perform at least one function, such as to prevent or balance over charge/discharge of the plurality of power sources 230; to regulate the electric current transferring from the plurality of power sources 230 to the motor 220; to regulate/control the temperature of the plurality of power sources 230 during charging and discharging thereof; to cool the plurality of power sources 230 during the utilization thereof, or a combination thereof. Advantageously, the utilization of the power source controller 248 can provide a prolonged life cycle for each one of the plurality of power sources 230, and/or to enhance electric power transfer therefrom.

According to some embodiments, the power source controller 248 is in electrical and/or functional communication with the control unit 240 and/or the plurality of power sources 230.

During the operation of underwater power unit 210, the power source controller 248 and/or the plurality of power sources 230, disposed within fin unit 216, can generate excessive heat. In order to prevent the controller 248 and/or the plurality of power sources 230 from overheating, heat or thermal energy needs to be transferred from fin unit 216 to the surrounding environment of underwater power unit 210. The surrounding environment of underwater power unit 210 can be air, or preferably water.

According to some embodiments, fin unit 216 comprises at least one thermally conductive material, selected from a metal, a metal alloy, a conductive polymer, and combinations thereof. The metal can be aluminum. According to some embodiments, at least a portion of each one of the at least two outer surfaces 218 of fin unit 216 comprises the at least one thermally conductive material. According to some embodiments, fin unit 216 is made of a thermally conductive material, such as for example, aluminum.

According to some embodiments, fin unit 216 further comprises at least one heat expel element (e.g., heat expel element 58, as disclosed above). According to some embodiments, fin unit 216 comprises at least two heat expel elements, wherein each one is located on each one of the outer surfaces 118 of fin unit 116 (not shown).

Since at least one of the controller 248, the power source housing 214, and the plurality of power sources 230 are in direct contact with the inner surfaces 254 of the thermally conductive fin unit 216, heat can easily transfer therefrom towards the surrounding environment of the underwater power unit 210. Advantageously, this configuration of unit 210, comprising the controller 248 and the power source housing 214 comprising the plurality of power sources 230 disposed within the thermally conductive fin unit 216, can enable enhanced heat expel capabilities and prevent from the controller 248 and/or power sources 230 to overheat, resulting in improved performance of underwater power unit 210 during operation thereof. Moreover, the alignment of the plurality of power sources 230 in a row (and optionally vertically to the central longitudinal axis 270) can improve the contact area between each one of the power sources 230 and the fin unit 216, thus further enhancing the heat expel capabilities thereof.

According to some embodiments, fin unit 216 is configured to be detachably attached to the main body 212 and to provide underwater power unit 210 with improved hydrodynamic behavior, when attached to a standard surfboard (e.g., standard surfboard 2). According to some embodiments, the present invention provides a variety of fin units 216 having different external dimensions, different shapes and geometries, and different numbers of pluralities of power sources 230 (i.e., batteries) disposed therein. According to some embodiments, the variety of fin units 216 are manufactured to have different rakes, different base lengths (e.g., base length 264) and different heights (e.g., height 266), similar to those of fin units 116 as disclosed herein above. According to some embodiments, the longest distance between the inner surfaces 254 of the at least two walls of fin unit 216 defines a base width 262, which is located in the vicinity of a lip (or end) of fin unit 216 and in the vicinity of the entrance to the hollow fin space 255 thereof (see FIG. 17). According to further embodiments, the variety of fin units 216 can also be manufactured to have different lengths of base width 262. Thus, the variety of fin units 216 can be suitable to a variety of users having different weights, a variety of wave types (such as small and large waves) or a variety of standard surfboards 2 (such as a shortboard or a SUP).

For example, fin unit 216 may have certain external dimensions which are suitable for applications in which unit 210 is connected to a SUP, and comprise a number of batteries suitable for providing unit 210 with enough thrusting force to propel said SUP. Alternatively, fin unit 216 may have smaller external dimensions (relative to the dimensions required for a SUP) which are suitable for applications in which unit 210 is connected to a shortboard, and comprise a smaller number of batteries (relative to the number of batteries required for propelling a SUP) suitable for providing unit 210 with enough thrusting force to propel said shortboard.

According to some embodiments, a ratio between the base width 262 and a height 266 of a fin unit 216, as illustrated at FIG. 17, is above about 0.1. According to further embodiments, the ratio between the base width 262 and the height 266 of the fin unit 216 (i.e., width/height) is above about 0.2. According to a specific embodiment, the ratio between the base width 262 and the height 266 of the fin unit 216 is above about 0.4, or preferably above about 0.42. According to some embodiments, the ratio between the base width 262 and the height 266 of the fin unit 216 is selected from the range of about 0.1-0.9. According to further embodiments, the ratio between the base width 262 and the height 266 of the fin unit 216 is selected from the range of about 0.1-0.5. It is contemplated, in some embodiments, that these ratios as presented herein between the base width 262 and the height 266 of the fin unit 216 can improve the hydrodynamic properties of underwater power unit 210, thus providing the user with increased control and stability over the surfboard.

For example, if the fin unit 216 has a fin base width of about 50 mm and a fin height of about 120 mm, the ratio between the base width 262 to the height 266 thereof is about 0.42 (i.e., width/height=0.42).

Previously disclosed motorized surfboards or motorized fins in the art are manufactured integrally with a specific fin having predetermined external dimensions and shape. In order to change the fin, the user is required to change the entire motorized device (e.g., motorized fin or surfboard), resulting in an optional highly expensive purchase of several motorized devices. Advantageously, the main body 212 as disclosed herein is modularly connectable to and compatible with various types of fin units 216 having different geometries and dimensions, so that the user is required to purchase a single main body 212 with optionally several types of fin units 216, thereby forming a variety underwater power units 210 suitable to different users, surfboards, and uses. Since the effective cost of a plurality of fin units 216 is significantly lower than the cost of a complete underwater power unit 210, due to lack of moving electric components, the present invention provides a simple, versatile and economic solution for motorized surfing.

The term "plurality", as used herein, means more than one.

The term "about", as used herein, when referring to a measurable value such as an amount, a temporal duration, and the like, is meant to encompass variations of +/−10%, more preferably +/−5%, even more preferably +/−1%, and still more preferably +/−0.1% from the specified value, as such variations are appropriate to the disclosed devices, systems and/or methods.

Additional Examples of the Disclosed Technology

In view of the above described implementations of the disclosed subject matter, this application discloses the additional examples enumerated below. It should be noted that one feature of an example in isolation or more than one feature of the example taken in combination and, optionally, in combination with one or more features of one or more further examples are further examples also falling within the disclosure of this application.

Example 1. An underwater power unit comprising:

(a) a power source housing comprising at least one power source disposed therein;

(b) a main body comprising:

a main body top surface comprising an upper main body adaptor platform configured to be detachably attached to an adaptor unit;

a main body bottom surface comprising a lower fin attachment section configured to have a fin unit detachably attached thereto;

a motor; and a control unit, wherein the main body top surface and main body bottom surface are located at opposing external surfaces of the main body, wherein at least one of the motor and the control unit are disposed within the main body, wherein the motor is coupled to a propeller via a shaft, wherein the motor is configured to be electronically coupled to the at least one power source and to receive electric power therefrom, wherein the motor is configured to generate a rotation of the propeller about a central longitudinal axis;

(c) a rear unit comprising said propeller and a protective cowling, wherein the protective cowling at least partially encompasses the propeller and a portion of said shaft; and (d) a fin unit comprising at least two walls, wherein each wall exhibits an outer surface and an inner surface opposing the outer surface, wherein the inner surfaces of the at least two walls define a hollow fin space therebetween, wherein the fin unit is configured to be detachably attached to the main body, wherein the fin unit comprises the power source housing disposed therein, wherein the underwater power unit extends from an underwater power unit front end towards an underwater power unit rear end along the central longitudinal axis, and wherein the shaft extends from the motor in a distal direction towards the underwater power unit rear end.

Example 2. The underwater power unit of any example herein, particularly example 1, wherein the power source housing comprising the at least one power source is disposed within the hollow fin space, and wherein the at least one power source is in direct contact with the inner surfaces of the fin unit.

Example 3. The underwater power unit of any example herein, particularly any one of examples 1 to 2, wherein the fin unit further comprises a power source controller disposed therein, wherein said controller is configured to transfer and balance electric power from the at least one power source to the motor.

Example 4. The underwater power unit of any example herein, particularly any one of examples 1 to 3, wherein the at least one power source is a battery.

Example 5. The underwater power unit of any example herein, particularly any one of examples 1 to 4, wherein the at least one power source comprises a plurality of batteries, such that the plurality of batteries are in direct contact with the inner surfaces of the fin unit.

Example 6. The underwater power unit of any example herein, particularly examples 5, wherein the plurality of batteries are aligned in a row.

Example 7. The underwater power unit of any example herein, particularly any one of examples 1 to 6, wherein the fin unit comprises at least one thermally conductive material.

Example 8. The underwater power unit of any example herein, particularly any one of examples 1 to 7, wherein the fin unit further comprises a fin unit cover configured to be secured or attached to the lower fin attachment section utilizing attachment means selected from the group consisting of bolts, screws, set screws, nails, pins, latches, snap-fit fasteners, bayonet mounts, and combinations thereof.

Example 9. The underwater power unit of any example herein, particularly any one of examples 1 to 8, wherein the central longitudinal axis extends through at least a portion of the control unit and at least a portion of the motor.

Example 10. The underwater power unit of any example herein, particularly any one of examples 1 to 9, wherein during the attachment of the main body to the fin unit, the underwater power unit front end of the main body and a front end of the outer surface of the fin unit are flush and form a continuous outer surface.

Example 11. The underwater power unit of any example herein, particularly any one of examples 1 to 10, wherein a ratio between a base width and a height of the fin unit is selected from the range of about 0.1-0.5.

Example 12. The underwater power unit of any example herein, particularly any one of examples 1 to 11, further comprising the adaptor unit, wherein the adaptor unit comprises an adaptor coupling surface configured to be detachably attached to the upper main body adaptor platform.

Example 13. The underwater power unit of any example herein, particularly example 12, wherein the adaptor unit further comprises a board coupling portion configured to be secured to a standard slot of a standard surfboard, thereby enabling detachable attachment of the underwater power unit to a standard surfboard.

Example 14. The underwater power unit of any example herein, particularly example 13, wherein the board coupling portion comprises FCS tabs, FCS II tabs, futures single tab, or a combination thereof.

Example 15. The underwater power unit of any example herein, particularly example 12, wherein the adaptor unit further comprises a user interaction portion comprising at least one of: a double handle, a single handle, an elastic strap, and combinations thereof.

Example 16. The underwater power unit of any example herein, particularly any one of examples 1 to 15, wherein the control unit comprises a processor and at least one of an electronic speed control unit (ESC) and a communication module.

Example 17. The underwater power unit of any example herein, particularly example 16, wherein the processor is in functional communication with at least one of the ESC, the communication module, the motor, the power source, or a combination thereof.

Example 18. An underwater power unit comprising:

(a) a power source housing comprising at least one power source disposed therein;

(b) a main body comprising:

a main body top surface comprising an upper main body adaptor platform configured to be detachably attached to an adaptor unit;

a main body bottom surface comprising a lower fin attachment section configured to have a fin unit detachably attached thereto;

a motor; and a control unit, wherein the main body top surface and main body bottom surface are located at opposing external surfaces of the main body, wherein at least one of the motor and the control unit are disposed within the main body, wherein the motor is coupled to a propeller via a shaft, wherein the motor is configured to be electronically coupled to the at least one power source and to receive electric power therefrom, wherein the motor is configured to generate a rotation of the propeller about a central longitudinal axis;

(c) a rear unit comprising said propeller and a protective cowling, wherein the protective cowling at least partially encompasses the propeller and a portion of said shaft; and (d) a fin unit comprising at least two walls, wherein each wall exhibits an outer surface and an inner surface opposing the outer surface, wherein the inner surfaces of the at least two walls define a hollow fin space therebetween, wherein the fin unit is configured to be detachably attached to the main body, wherein the underwater power unit extends from an underwater power unit front end towards an underwater power unit rear end along the central longitudinal axis, wherein the shaft extends from the motor in a distal direction towards the underwater power unit rear end, wherein the control unit is located in a respective position radially offset from the central longitudinal axis and the motor, wherein the main body further comprises a control unit housing located in a respective position radially offset from the central longitudinal axis and extending downward from the main body bottom surface, wherein the control unit is disposed within the control unit housing, wherein the fin unit is configured to interact with or to encompass the control unit housing, and wherein the hollow fin space enables the inner surfaces of the fin unit to encompass and contact the control unit housing when attached thereto.

Example 19. The underwater power unit of any example herein, particularly example 18, wherein the power source housing is detachably attached to the main body through a releasable mechanism selected from the group consisting of a snap-fit fastener, bayonet mount, a latch, and a releasable engagement mechanism, and wherein the power source housing is aligned with the main body along the central longitudinal axis, when attached thereto.

Example 20. The underwater power unit of any example herein, particularly any one of examples 18 to 19, wherein the fin unit is configured to be detachably attached to the lower fin attachment section of the main body utilizing attachment means selected from the group consisting of bolts, screws, set screws, nails, pins, latches, snap-fit fasteners, bayonet mounts, and combinations thereof.

Example 21. The underwater power unit of any example herein, particularly any one of examples 18 to 20, wherein the control unit housing comprises at least one thermally conductive material.

Example 22. The underwater power unit of any example herein, particularly any one of examples 18 to 21, wherein the fin unit further comprises at least one heat expel element configured to enable heat transportation from the control unit housing to the surrounding environment therethrough.

Example 23. The underwater power unit of any example herein, particularly example 22, wherein the at least one heat expel element is a heat expel opening comprising at least one opening extending through at least one wall of the fin unit, configured to enable direct contact between the control unit housing and the surrounding environment.

Example 24. The underwater power unit of any example herein, particularly example 22, wherein the at least one heat expel element is a heat expel conducting surface comprising a conductive thermal material.

Example 25. The underwater power unit of any example herein, particularly any one of examples 22 to 24, wherein the fin unit comprises a plurality of heat expel elements.

Example 26. The underwater power unit of any example herein, particularly any one of examples 22 to 25, wherein each one of the outer surfaces of the fin unit comprises: a heat expel opening, a first heat expel conducting surface and a second heat expel conducting surface.

Example 27. The underwater power unit of any example herein, particularly any one of examples 18 to 26, wherein a ratio between a base width and a height of the fin unit is selected from the range of about 0.1-0.5.

Example 28. The underwater power unit of any example herein, particularly any one of examples 18 to 27, further comprising the adaptor unit, wherein the adaptor unit comprises an adaptor coupling surface configured to be detachably attached to the upper main body adaptor platform.

Example 29. The underwater power unit of any example herein, particularly example 28, wherein the adaptor unit further comprises a board coupling portion configured to be secured to a standard slot of a standard surfboard, thereby enabling detachable attachment of the underwater power unit to a standard surfboard.

Example 30. The underwater power unit of any example herein, particularly example 29, wherein the board coupling portion comprises FCS tabs, FCS II tabs, futures single tab, or a combination thereof.

Example 31. The underwater power unit of any example herein, particularly example 28, wherein the adaptor unit further comprises a user interaction portion comprising at least one of: a double handle, a single handle, an elastic strap, and combinations thereof.

Example 32. The underwater power unit of any example herein, particularly any one of examples 18 to 31, wherein the control unit comprises a processor and at least one of an electronic speed control unit (ESC) and a communication module.

Example 33. The underwater power unit of any example herein, particularly example 32, wherein the processor is in functional communication with at least one of the ESC, the communication module, the motor, the power source, or a combination thereof.

Example 34. The underwater power unit of any example herein, particularly any one of examples 18 to 33, wherein the at least one power source comprises a plurality of batteries.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. No feature described in the context of an embodiment is to be considered an essential feature of that embodiment, unless explicitly specified as such.

In view of the many possible embodiments to which the principles of the disclosure may be applied, it should be recognized that the illustrated embodiments are only preferred examples and should not be taken as limiting the scope. Rather, the scope is defined by the following claims. We therefore claim all that comes within the scope and spirit of these claims.

The invention claimed is:

1. An underwater power unit comprising:

(a) a power source housing comprising at least one power source disposed therein;

(b) a main body comprising:

a main body top surface comprising an upper main body adaptor platform configured to be detachably attached to an adaptor unit;

a main body bottom surface comprising a lower fin attachment section configured to have a fin unit detachably attached thereto;

a motor; and a control unit, wherein the main body top surface and main body bottom surface are located at opposing external surfaces of the main body, wherein at least one of the motor and the control unit are disposed within the main body, wherein the motor is coupled to a propeller via a shaft, wherein the motor is configured to be electronically coupled to the at least one power source and to receive electric power therefrom, wherein the motor is configured to generate a rotation of the propeller about a central longitudinal axis;

(c) a rear unit comprising said propeller and a protective cowling, wherein the protective cowling at least partially encompasses the propeller and a portion of said shaft; and (d) a fin unit comprising at least two walls, wherein each wall exhibits an outer surface and an inner surface opposing the outer surface, wherein the inner surfaces of the at least two walls define a hollow fin space therebetween, wherein the fin unit is configured to be detachably attached to the main body, wherein the fin unit comprises the power source housing disposed therein, wherein the underwater power unit extends from an underwater power unit front end towards an underwater power unit rear end along the central longitudinal axis, and wherein the shaft extends from the motor in a distal direction towards the underwater power unit rear end.

2. The underwater power unit according to claim 1, wherein the power source housing comprising the at least one power source is disposed within the hollow fin space, and wherein the at least one power source is in direct contact with the inner surfaces of the fin unit.

3. The underwater power unit according to claim 1, wherein the fin unit further comprises a power source controller disposed therein, wherein said controller is configured to transfer and balance electric power from the at least one power source to the motor.

4. The underwater power unit according to claim 1, wherein the at least one power source is a battery.

5. The underwater power unit according to claim 1, wherein the at least one power source comprises a plurality of batteries, such that the plurality of batteries are in direct contact with the inner surfaces of the fin unit.

6. The underwater power unit according to claim 5, wherein the plurality of batteries are aligned in a row.

7. The underwater power unit according to claim 1, wherein the fin unit comprises at least one thermally conductive material.

8. The underwater power unit according to claim 1, wherein the fin unit further comprises a fin unit cover configured to be secured or attached to the lower fin attachment section utilizing attachment means selected from the group consisting of bolts, screws, set screws, nails, pins, latches, snap-fit fasteners, bayonet mounts, and combinations thereof.

9. The underwater power unit according to claim 1, wherein the central longitudinal axis extends through at least a portion of the control unit and at least a portion of the motor.

10. The underwater power unit according to claim 1, wherein during the attachment of the main body to the fin unit, the underwater power unit front end of the main body and a front end of the outer surface of the fin unit are flush and form a continuous outer surface.

11. The underwater power unit according to claim 1, wherein a ratio between a base width and a height of the fin unit is selected from the range of about 0.1-0.5.

12. The underwater power unit according to claim 1, further comprising the adaptor unit, wherein the adaptor unit comprises an adaptor coupling surface configured to be detachably attached to the upper main body adaptor platform.

13. The underwater power unit according to claim 12, wherein the adaptor unit further comprises a board coupling portion configured to be secured to a standard slot of a standard surfboard, thereby enabling detachable attachment of the underwater power unit to a standard surfboard.

14. The underwater power unit according to claim 13, wherein the board coupling portion comprises FCS tabs, FCS II tabs, futures single tab, or a combination thereof.

15. The underwater power unit according to claim 12, wherein the adaptor unit further comprises a user interaction portion comprising at least one of: a double handle, a single handle, an elastic strap, and combinations thereof.

16. The underwater power unit according to claim 1, wherein the control unit comprises a processor and at least one of an electronic speed control unit (ESC) and a communication module.

17. The underwater power unit according to claim 16, wherein the processor is in functional communication with at least one of the ESC, the communication module, the motor, the power source, or a combination thereof.

* * * * *